US008430393B2

(12) United States Patent
Matsushima et al.

(10) Patent No.: US 8,430,393 B2
(45) Date of Patent: Apr. 30, 2013

(54) SHEET FEEDING APPARATUS AND IMAGE FORMING APPARATUS

(75) Inventors: Akira Matsushima, Susono (JP); Yasuhiro Uchida, Yokohama (JP); Shunsuke Okazaki, Mishima (JP); Minoru Kawanishi, Yokohama (JP); Kenji Watanabe, Suntou-gun (JP); Motohiro Furusawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/834,242

(22) Filed: Jul. 12, 2010

(65) Prior Publication Data

US 2011/0006469 A1 Jan. 13, 2011

(30) Foreign Application Priority Data

Jul. 13, 2009 (WO) ..... PCT/JP2009/062671

(51) Int. Cl.
*B65H 5/00* (2006.01)

(52) U.S. Cl.
USPC ..... 271/10.13; 271/10.01; 271/10.09; 271/10.11; 271/122; 271/125

(58) Field of Classification Search ..... 271/122, 271/125, 10.13, 10.03, 10.01, 10.09, 10.11
See application file for complete search history.

(56) References Cited

U.S. PATENT DOCUMENTS

| | | | | |
|---|---|---|---|---|
| 5,664,771 | A * | 9/1997 | Nagatani et al. | 271/10.03 |
| 6,378,858 | B1 | 4/2002 | Suga | |
| 6,533,263 | B2 * | 3/2003 | Tamura | 271/10.01 |
| 6,672,579 | B2 * | 1/2004 | Araki et al. | 271/122 |
| 7,354,038 | B2 * | 4/2008 | Watase | 271/10.13 |
| 7,726,645 | B2 * | 6/2010 | Gerlier et al. | 271/122 |
| 7,770,881 | B2 * | 8/2010 | Yokemura et al. | 271/10.13 |
| 2006/0214356 | A1 * | 9/2006 | Yasukawa et al. | 271/10.13 |
| 2006/0220297 | A1 * | 10/2006 | Kusumi | 271/10.01 |
| 2010/0102499 | A1 * | 4/2010 | Takamori et al. | 271/10.13 |

FOREIGN PATENT DOCUMENTS

| | | | |
|---|---|---|---|
| JP | 58119525 | A * | 7/1983 |
| JP | 01092137 | A * | 4/1989 |
| JP | 01104538 | A * | 4/1989 |
| JP | 03013431 | A * | 1/1991 |
| JP | 04055226 | A * | 2/1992 |
| JP | 2000-177874 | | 6/2000 |
| JP | 2001-26328 | | 1/2001 |
| JP | 2001-341869 | | 12/2001 |
| JP | 2002-145469 | | 5/2002 |

* cited by examiner

*Primary Examiner* — Luis A Gonzalez
(74) *Attorney, Agent, or Firm* — Canon USA Inc IP Division

(57) ABSTRACT

When a retard roller is rotating in a sheet feeding direction, the rotation is transmitted to a pickup roller and the pickup roller rotates in a direction for conveying the sheet. When the retard roller is rotating in a direction opposite to the sheet feeding direction or is stationary, the pickup roller does not feed the sheet. Therefore, in a successive feeding operation, the sheet to be fed next is always conveyed such that the leading end thereof reaches a nip position between a feed roller and the retard roller. Therefore, the intervals between the sheets are uniform in the successive feeding operation.

16 Claims, 24 Drawing Sheets

SHEET FEEDING APPARATUS AND IMAGE FORMING APPARATUS

FIELD OF THE INVENTION

The present invention relates to a sheet feeding apparatus provided in an image forming apparatus, such as a printer, a facsimile machine, and a copy machine, for supplying a sheet of, for example, recording paper or document.

DESCRIPTION OF THE RELATED ART

An example of an image forming apparatus of a related art includes a sheet feeding apparatus for automatically feeding a sheet toward an image forming unit that forms an image on the sheet. Such a sheet feeding apparatus includes a sheet stacking portion provided in a sheet storage section such that the sheet stacking portion can be raised and lowered and a sheet feeding section that feeds the uppermost one of sheets stacked on the sheet stacking portion. The sheet stacking portion is moved upward so that the uppermost one of the stacked sheets reaches a sheet feedable position, and then the uppermost sheet is fed toward the image forming unit by the sheet feeding section.

An example of a sheet feeding apparatus will be explained with reference to FIGS. 24A and 24B. Referring to FIG. 24A, a sheet feeding cassette 1100, which functions as a sheet storage section, can be pulled out from an apparatus body. While the sheet feeding cassette 1100 is in a pulled-out state, sheets Sa are placed on an intermediate plate 1101, which functions as a sheet stacking portion, of the sheet feeding cassette 1100. A sheet feeding section for successively feeding the sheets Sa on the intermediate plate 1101 is disposed in the apparatus body. The sheet feeding section includes a pickup roller 1053 that comes into contact with the top surface of the uppermost one of the sheets Sa stacked on the intermediate plate 1101 to convey the uppermost sheet and a separating portion that separates the sheets conveyed by the pickup roller 1053 from each other. The separating portion includes a feed roller 1054 that is rotationally driven in a direction for feeding the sheets and a retard roller 1055 that can be pressed against the feed roller 1054 and that is rotationally driven in a direction for conveying the sheets in the reverse direction.

The pickup roller 1053 is held by a roller holder 1110 that is rotatably attached to a driving shaft of the feed roller 1054. A driving force transmitted to the feed roller 1054 is also transmitted to the pickup roller 1053 from the driving shaft of the feed roller 1054 through a gear train (not shown). The roller holder 1110 is provided with a sensor lever 1110*a*, and the sensor lever 1110*a* is arranged to turn on or off a signal of an optical sensor 1111 in accordance with the rotational position of the roller holder 1110. The sensor lever 1110*a* turns on or off the signal of the optical sensor 1111 at a position where an appropriate sheet feeding pressure for feeding a sheet is applied to the top surface of the sheet by the pickup roller 1053. The sheet feeding pressure is a pressure applied between the pickup roller 1053 and the top surface of the sheet to feed the sheet. Unless the sheet feeding pressure is appropriate, there is a risk that the sheet cannot be conveyed or the uppermost sheet and the next sheet will be simultaneously fed.

The intermediate plate 1101 can be raised and lowered, and is pushed upward by a lifter 1102 that is rotated by a motor (not shown). As the sheets are fed and the number of sheets stacked on the intermediate plate 1101 is reduced, the pickup roller 1053 moves downward. Accordingly, the lifter 1102 is rotated by the motor on the basis of the detection result of the optical sensor 1111, so that the intermediate plate 1101 is moved upward. Thus, the intermediate plate 1101 is moved upward every time the height of the top surface of the uppermost sheet becomes lower than a predetermined height during feeding of the sheets Sa. Accordingly, the top surface of the uppermost sheet is maintained at a height at which the appropriate sheet feeding pressure can be applied. When a sheet feeding signal is transmitted from an image forming apparatus, the pickup roller 1053 rotates while being in contact with the uppermost one of the sheets stacked on the intermediate plate 1101. Accordingly, the uppermost sheet S1 is conveyed to the separating portion. In the separating portion, the sheets conveyed by the pickup roller 1053 are separated from each other between the feed roller 1054 and the retard roller 1055, and are fed to the image forming unit. Each time the sheet feeding signal is transmitted from the image forming apparatus, the above-described process is repeated to feed the sheets to the image forming apparatus one at a time. Then, an image is formed on each sheet in the image forming unit.

However, in the above-described sheet feeding apparatus according to the related art, the following problems occur when the sheets are successively fed. That is, if the frictional force generated between the sheets stacked on the intermediate plate 1101 is small, the uppermost sheet S1 is unlikely to be conveyed together with the next sheet S2 when the sheet S1 is fed by the pickup roller 1053. Therefore, as illustrated in FIG. 24A, the position of the leading end S2*a* of the next sheet S2 does not project from the front edge of the sheet feeding cassette 1100. Therefore, feeding of the next sheet S2 starts while the leading end of the next sheet S2 is at the front edge of the sheet feeding cassette 1100. In contrast, if the frictional force generated between the sheets to be fed is relatively large, the next sheet S2 will be moved in a feeding direction together with the uppermost sheet S1 that is being fed. In this case, the sheet S1 that is being fed and the next sheet S2 are separated from each other by the separating portion. However, the leading end of the next sheet S2 is moved to a nip position between the feed roller 1054 and the retard roller 1055 in the separating portion, as illustrated in FIG. 24B. Alternatively, depending on the frictional force between the sheets, the next sheet S2 may stop in a state such that the leading end of the sheet S2 is positioned between the front edge of the sheet feeding cassette and the separating portion instead of reaching the separating portion.

As described above, the position of the leading end of each sheet to be conveyed varies over a distance X between the front edge of the sheet feeding cassette and the nip position between the feed roller 1054 and the retard roller 1055 in accordance with, for example, the difference in the coefficient of friction between the sheets. Therefore, there is a risk that the time interval from when feeding of a sheet is started in response to the sheet feeding signal to when the sheet reaches the image forming unit will vary for each sheet over an interval corresponding to the distance X. As a result, the process of forming an image on the sheet cannot be started with high reliability. In addition, in consideration of the above-described variation, intervals between the sheets for when the sheets are successively fed without allowing the sheets to be fed while being stacked on each other must be set to a large value. Therefore, there is a problem that the productivity is reduced. The term "productivity" used herein refers to the number of sheets on which images can be formed per unit time.

To solve the above-described problem, a technique has been suggested in which sheet detection means for detecting the leading end of a sheet that is being fed is disposed downstream of the separating portion and sheet conveyance control is performed on the basis of the result of the detection. According to this technique, if the time interval from when the sheet feeding signal is received to when a sheet is detected by the sheet detecting means is shorter than a predetermined time interval, the conveying speed of the following sheets is reduced. If the above-mentioned time interval is longer than the predetermined time interval, the conveying speed of the following sheets is increased. Thus, whether the arrival of a sheet is early or late is determined on the basis of the detection result of the sheet detection means, and the conveying speed of the next sheet is controlled on the basis of the result of the determination. Accordingly, the variation in the intervals between the sheets that are fed can be reduced (see PTL 1).

Citation List

However, with the technique of determining whether the arrival of a sheet is early or late on the basis of the detection result of the sheet detection means and controlling the conveying speed of the next sheet, complex control must be performed. In addition, when, for example, there is a large variation in the position of the leading end of each sheet or when a sheet conveying path from the separating portion to the image forming apparatus is short, there is a risk that the effect of the conveying speed control is not sufficient and the variation cannot be sufficiently reduced. To avoid such a risk, it is necessary to quickly increase or reduce the conveying speed. Therefore, load applied to the motor that drives each roller is increased and it is necessary to use a high-quality motor and strong components for transmitting the driving force. As a result, there is a risk that the costs will be increased.

In light of the above-described situation, an object of the present invention is to provide a sheet feeding apparatus capable of reducing the variation in the sheet feeding operation without performing the complex control of the sheet conveying speed, so that the sheets can be fed at a uniform interval.

SUMMARY OF INVENTION

A sheet feeding apparatus according to the present invention includes a sheet stacking portion on which sheets are stacked; a pickup roller that feeds an uppermost one of the sheets stacked on the sheet stacking portion; a feed roller that feeds the sheet conveyed by the pickup roller; and a retard roller that is pressed against the feed roller and that receives a driving force in a direction opposite to a feeding direction through a torque limiter. The pickup roller feeds a sheet on the sheet stacking portion when the retard roller is rotating in the feeding direction and does not feed the sheet on the sheet stacking portion when the retard roller is rotating in the direction opposite to the feeding direction or is stationary.

Further features of the present invention will become apparent from the following description of exemplary embodiments with reference to the attached drawings.

BRIEF DESCRIPTION OF DRAWINGS

FIGS. 21A to 20F show diagrams illustrating the operation of the sheet feeding apparatus according to the fifth embodiment.

DESCRIPTION OF EMBODIMENTS

First Embodiment

Figure 7:
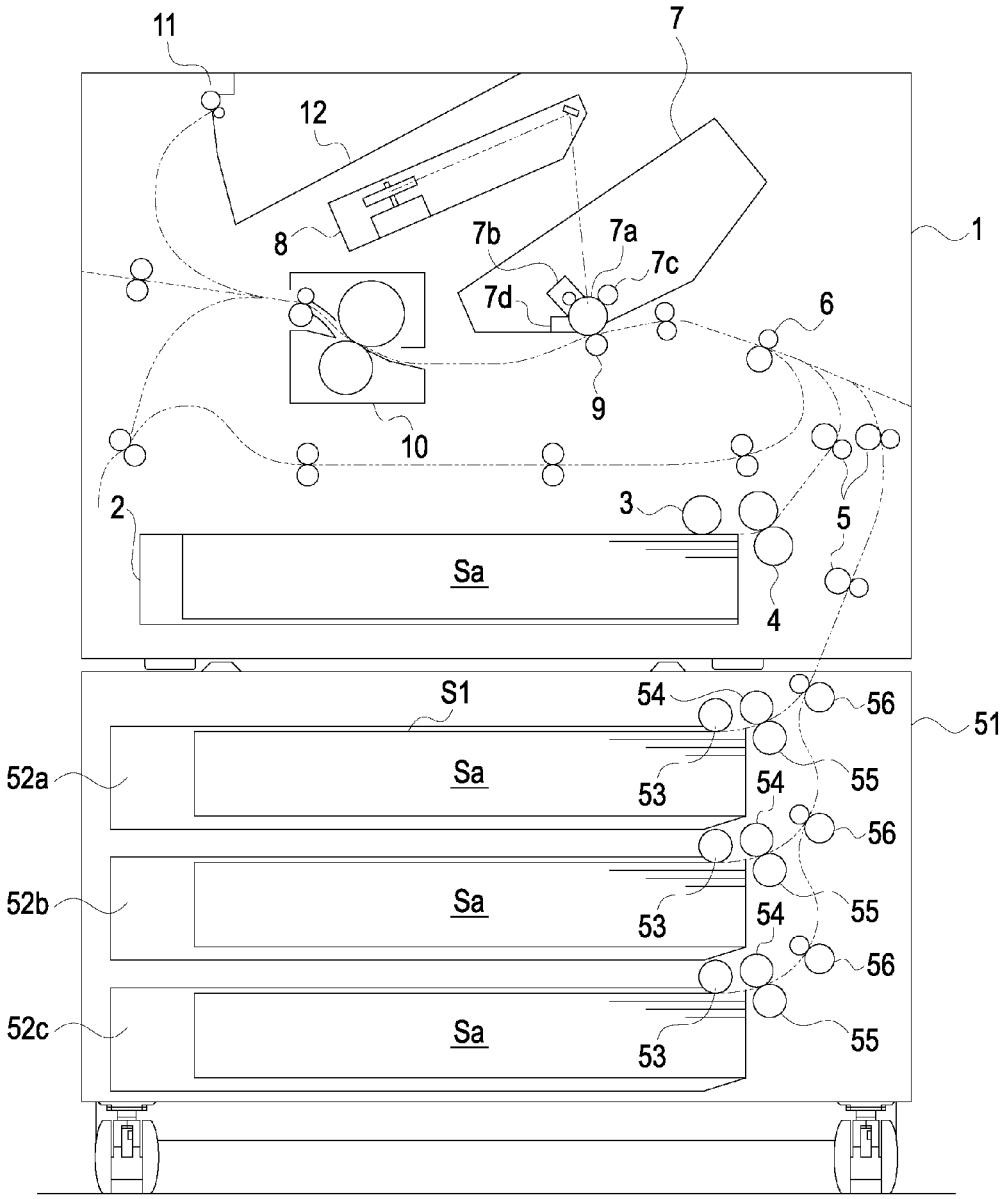
FIG. 7 is a sectional view of an example of a printer in which the sheet feeding apparatus according to the present invention is installed.
Figure 8:
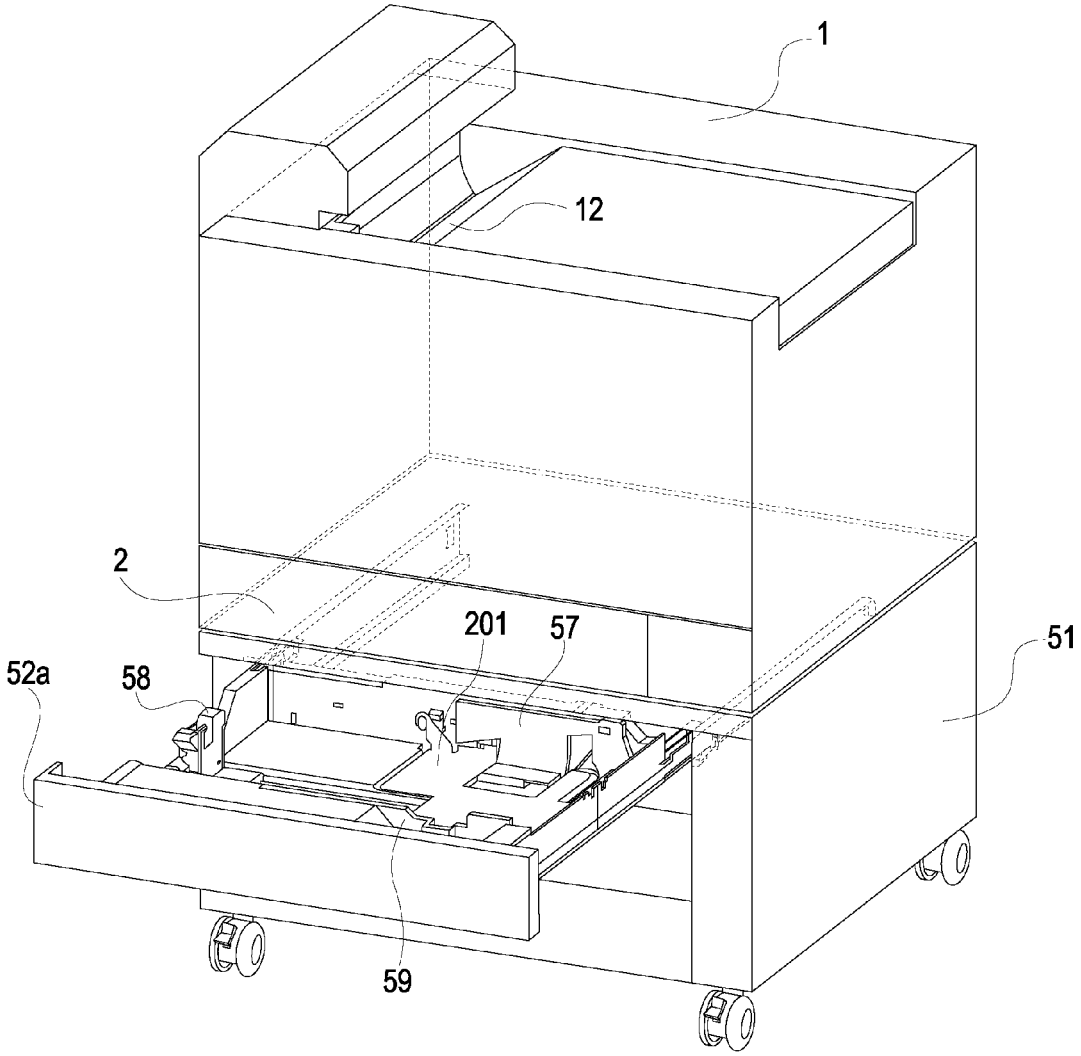
FIG. 8 is a perspective view illustrating the state in which a sheet feeding cassette is pulled out from the printer illustrated in FIG. 7.

A sheet feeding apparatus according to an embodiment of the present invention will now be described. The sheet feeding apparatus is provided in a laser beam printer (hereinafter referred to as an LBP), which functions as an image forming apparatus. First, the schematic structure of the LBP will be described with reference to FIGS. 7 and 8. FIG. 7 is a sectional view illustrating the overall structure of the LBP including a sheet storage apparatus. FIG. 8 is a perspective view illustrating the state in which a sheet feeding cassette provided in the sheet storage apparatus is pulled out.

Referring to FIG. 7, reference numeral 1 denotes the LBP which functions as an image forming apparatus, and 2 denotes a sheet feeding cassette which is disposed in the LBP 1 and in which sheets Sa are stacked. Reference numeral 3 denotes a pickup roller that comes into contact with the uppermost one of the sheets Sa stacked on the sheet feeding cassette 2 to convey the uppermost sheet. Reference numeral 4 denotes a pair of separation rollers which convey the sheet S fed by the pickup roller 3 after separating the sheet S from each other. Reference numeral 7 denotes a process cartridge including a known electrophotographic process means for forming an image. The process cartridge 7 is detachably attached to the main body of the image forming apparatus. The process cartridge 7 includes a photosensitive drum 7*a* that functions as an image bearing member, and the photosensitive drum 7*a* is irradiated with a laser beam by a laser exposure device 8 in accordance with image information. A charging unit 7*b*, a developing unit 7*c*, a cleaning unit 7*d*, etc., for developing a toner image and cleaning the photosensitive drum 7*a* are arranged around the photosensitive drum 7*a*. A transfer roller 9 is in contact with the photosensitive drum 7*a*. A sheet S is conveyed by conveying rollers 5 and 6 disposed along a sheet conveying path, and the toner image formed on the drum surface is transferred onto the sheet S when the sheet S passes between the photosensitive drum 7*a* and the transfer roller 9.

Reference numeral 10 denotes a fixing device which fixes the toner image that has been transferred onto the sheet S by applying heat and pressure to the sheet S. Then, the sheet S on which the toner image has been fixed is ejected by a pair of ejection rollers 11 to an ejection tray 12 on the top surface of the apparatus such that the image formed on the sheet S faces downward.

A cassette deck 51 that includes a plurality of sheet feeding cassettes and that functions as the sheet storage apparatus is disposed below the LBP 1. The cassette deck 51 also functions as a support base for the LBP 1, and is provided with four casters at four positions on the bottom surface of the sheet storage apparatus so that the cassette deck 51 can be moved while the LBP 1 is placed thereon. The cassette deck 51 includes three sheet feeding cassettes 52*a*, 52*b*, and 52*c*, which are structured such that sheets in different sizes and basis weights can be stored and fed. A sheet feeding section for feeding sheets is provided for each of the sheet feeding cassette 52*a*, 52*b*, and 52*c*. When the cassette deck 51 receives a sheet feeding signal from the LBP 1, the cassette deck 51 selects a sheet feeding cassette that stores the sheets suitable for the received signal, and supplies the sheet S to the LBP one at a time. The sheet feeding cassettes and the respective sheet feeding sections provided in the cassette deck 51 will now be described. Since the three sheet feeding cassettes and the respective sheet feeding sections have similar structures, the sheet feeding cassette and the sheet feeding section disposed at the top will be explained as an example.

As illustrated in FIG. 8, the sheet feeding cassette 52*a*, which functions as a sheet storage section for storing sheets, is provided with an intermediate plate 201 which functions as a sheet stacking portion on which a stack of sheets is placed. The intermediate plate 201 can be raised and lowered. The sheet feeding cassette 52*a* is also provided with side aligning plates 57 and 59 for aligning the sides of the sheets stacked on the intermediate plate 201, and a back end aligning plate 58 for aligning the back ends of the stacked sheets. Referring to FIG. 7, a pickup roller 53, which functions as a sheet feeding means for conveying the uppermost sheet S1 in the stack of sheets Sa placed on the intermediate plate 201, is provided in the main body of the cassette deck 51. In addition, a feed roller 54 and a retard roller 55 are provided as a pair of separation rollers of a separating portion for separating the sheets conveyed by the pickup roller 53 from each other. In addition, a pair of conveying rollers 56 for conveying the sheets that have been separated from each other by the pair of separation rollers toward the LBP 1 are disposed on the sheet conveying path.

Figure 1:
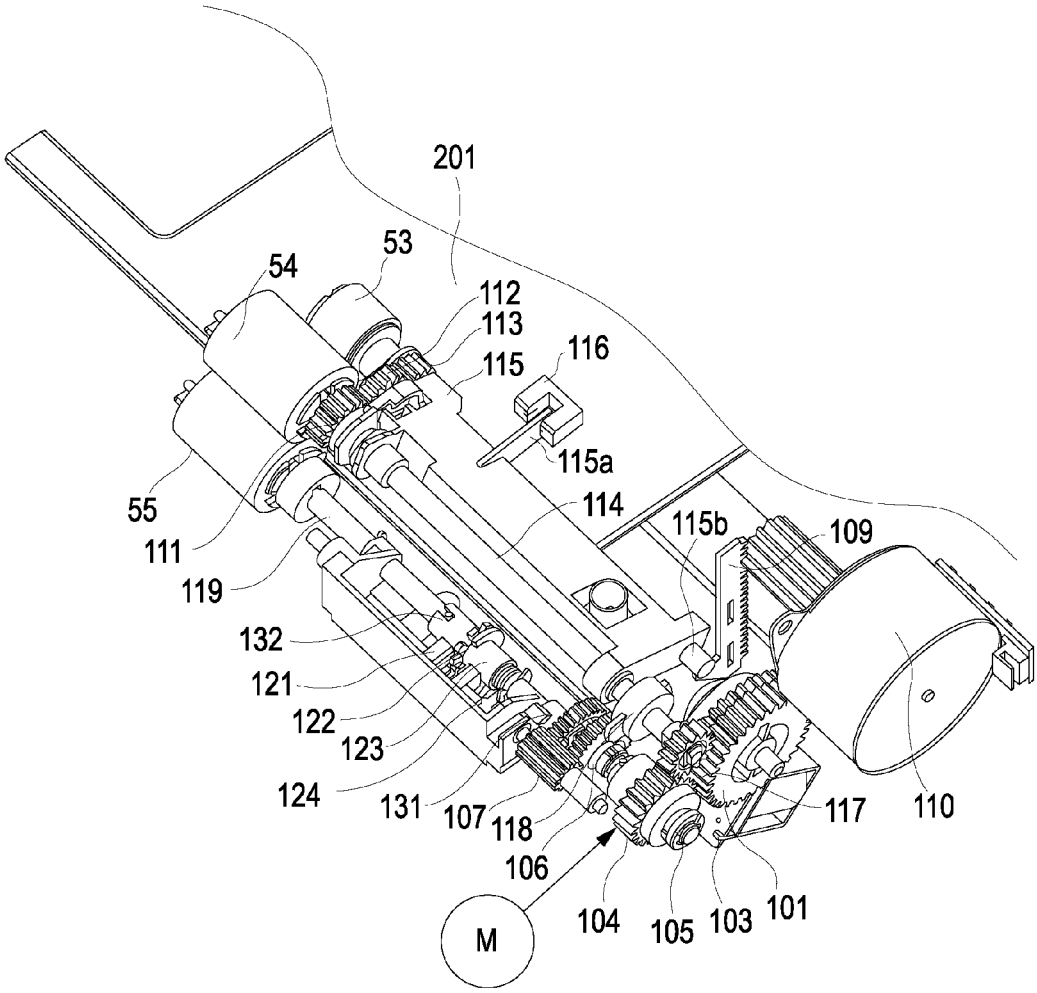
FIG. 1 is a perspective view of a sheet feeding section of a sheet feeding apparatus according to a first embodiment of the present invention.

The detailed structure of the sheet feeding section, which characterizes the present embodiment, will be described with reference to FIGS. 1, 2A and 2B. FIG. 1 is a perspective view of the sheet feeding section viewed from the front in the feeding direction, and FIG. 2A is a perspective view of the sheet feeding section viewed from the back in the feeding direction.

Figure 2A:
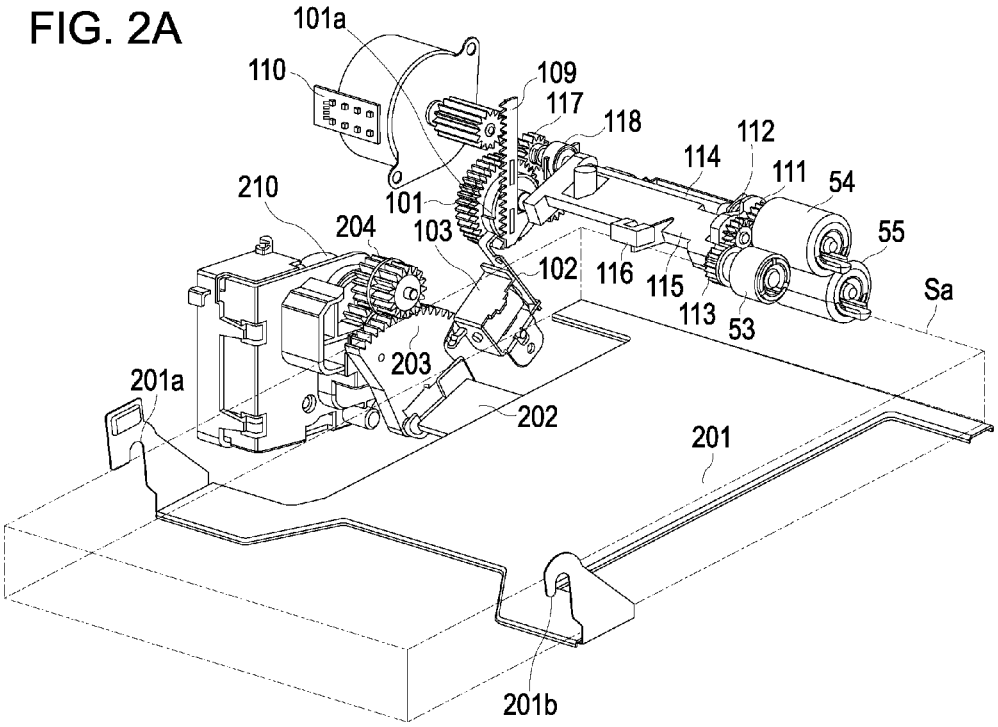
FIGS. 2A and 2B show a perspective view of the sheet feeding section illustrated in FIG. 1 viewed from the opposite side.
Figure 2B:
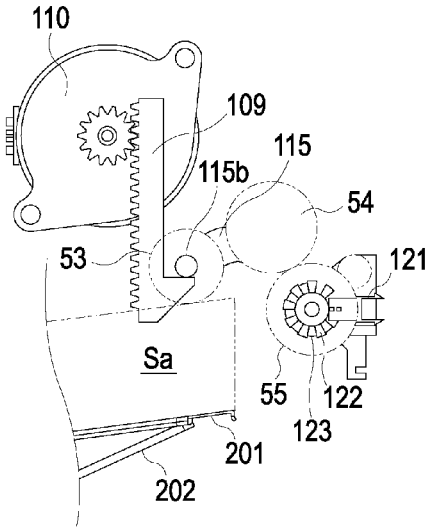

As illustrated in FIG. 2A, the intermediate plate 201 is provided on a frame of the sheet feeding cassette 52 such that the intermediate plate 201 is vertically rotatable about engagement portions 201*a* and 201*b*. The intermediate plate 201 is vertically rotated by an upward pressing plate 202 disposed at the bottom side of the intermediate plate 201. A fan-shaped gear 203 is provided at one end of the upward pressing plate 202. The fan-shaped gear 203 meshes with a pinion 204 that is rotated by a lift motor 210 provided in the main body of the cassette deck 51. The fan-shaped gear 203 is rotated by the rotation of the pinion 204, and accordingly the intermediate plate 201 is moved upward by the upward pressing plate 202. The upward pressing plate 202, the fan-shaped gear 203, and the pinion 204 form a lifter unit. The lift motor 210 is driven and controlled by a control unit C illustrated in FIG. 3. The control unit C causes the lift motor 210 to rotate the pinion 204 on the basis of a detection signal from a position detection sensor 116, which will be described below, so that a downstream end of the intermediate plate 201 is raised toward the pickup roller 53 by the operation of the fan-shaped gear 203 and the upward pressing plate 202.

Figure 3:
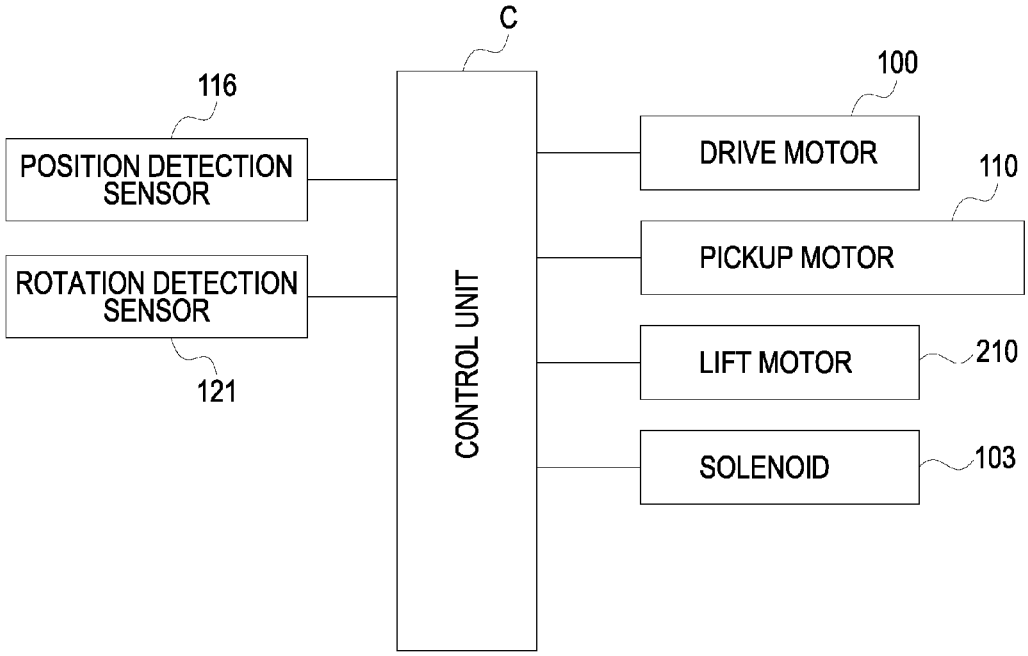
FIG. 3 is a diagram illustrating a control block provided in the sheet feeding apparatus illustrated in FIG. 1.

FIG. 3 is a control block diagram. The control unit C receives detections signals from the position detection sensor 116 and a rotation detection sensor 121, which will be described below. In addition, the control unit C controls a drive motor 100, a pickup motor 110, the lift motor 210, and a solenoid 103 on the basis of the detection signals from the sensors.

The pickup roller 53 is rotatably held by a roller holder 115 that is rotatably attached to a shaft 114 of the feed roller 54. The roller holder 115 is provided with a sensor lever 115*a*. If the pickup roller 53 is at a position where an appropriate pressure can be applied when a sheet is fed, the sensor lever 115*a* blocks light in the position detection sensor 116. The roller holder 115, the sensor lever 115*a*, and the position detection sensor 116 form a detection section of the present embodiment. The detection sensor 116 is an optical sensor, and outputs an on signal or an off signal depending on whether the light is transmitted or blocked by the sensor lever 115*a*.

As the sheets Sa are successively fed one at a time, the number of sheets Sa stacked on the intermediate plate 201 decreases and the position of the top surface of the uppermost sheet becomes lower. Accordingly, the pickup roller 53 moves downward together with the roller holder 115. When the roller holder 115 is moved downward, the sensor lever 115*a* stops blocking the light in the position detection sensor 116 and the position detection sensor 116 is set to an undetected state. If the roller holder 115 is moved downward to the position where the position detection sensor 116 is set to the undetected state and is moved further downward, the pickup roller 53 can no longer apply the appropriate sheet feeding pressure to the top surface of the uppermost one of the sheets Sa. Therefore, when the position detection sensor 116 is set to the undetected state, the control unit C controls the lift motor to cause the upward pressing plate 202 in the lifter unit to move the intermediate plate 201 upward again to the position where the appropriate pressure can be applied to the top surface of the uppermost one of the sheets Sa in the sheet feeding operation. Every time the position detection sensor 116 is set to the undetected state during successive feeding of the sheets, the control is repeatedly performed to cause the lifter unit to move the intermediate plate 201 so that the top surface of the uppermost sheet is moved to a predetermined position. Therefore, the sheets can be reliably fed until all of the sheets on the intermediate plate 201 are fed.

Next, a sheet feeding mechanism for feeding the sheets on the intermediate plate 201 will be described. In FIG. 1, reference numeral 104 denotes a limiter gear which includes a gear portion for transmitting a driving force from the drive motor 100 and in which a torque limiter is provided. The gear portion is connected to a shaft 105 with the torque limiter provided therebetween. The shaft 105 is connected to the retard roller 55 with a drive connection mechanism, which will be described below, provided therebetween. When the load applied to the retard roller 55 is smaller than the transmitting driving force (limit value) of the torque limiter, the limiter gear 104 rotates the shaft 105 with the driving force of the drive motor 100. When the load applied to the retard roller 55 is larger than the transmitting driving force of the torque limiter, the limiter gear 104 slips with respect to the shaft 105. The transmitting driving force (limit value) of the torque limiter in the limiter gear 104 is set such that the transmitting driving force is definitely larger than the frictional force between the sheets based on the coefficient of friction between the sheets being used. In addition, the transmitting driving force (limit value) of the torque limiter in the limiter gear 104 is set to be smaller than the frictional force based on the coefficient of friction between the feed roller 54 and the sheets. Therefore, when a single sheet is at a nip position between the feed roller 54 and the retard roller 55 or when there is no sheet at the nip position, the retard roller 55 is rotated by the rotation of the feed roller 54. When two or more sheets are at the nip position, the retard roller 55 rotates in a direction opposite to the feeding direction to separate the sheets from each other.

Reference numeral 101 denotes a partially toothed gear that controls the transmission of rotation to the feed roller 54, and 102 denotes a lever member that is operated by the solenoid 103. The lever member 102 is engageable with an engagement portion 101*a* that is formed integrally with the partially toothed gear 101 to restrain the rotation of the partially toothed gear 101. The lever member 102 is caused to engage with or disengage from the engagement portion 101*a* depending on whether the solenoid 103 is in an on state or an off state. More specifically, when the feeding signal is transmitted, electricity is supplied to the solenoid 103 and the solenoid 103 is switched from the off state to the on state. Accordingly, the lever member 102 is pulled by the solenoid 103 and is moved away from the engagement portion 101*a* of the partially toothed gear 101, so that the partially toothed gear 101 is released from the state in which the rotation thereof is restricted. In the state in which the partially toothed gear 101 is stopped by the lever member, a toothless portion of the partially toothed gear 101 faces the limiter gear.

A spring (not shown) is disposed in the partially toothed gear 101. When the partially toothed gear 101 is released from the lever member 102, the partially toothed gear 101 is rotated by the spring force applied by the spring so that a gear portion of the partially toothed gear 101 meshes with the limiter gear 104. The limiter gear 104 is continuously rotated by the driving force of the drive motor 100. Therefore, the partially toothed gear 101 is rotated when the partially toothed gear 101 meshes with the limiter gear 104. Then, when the partially toothed gear 101 rotates one revolution, the lever member 102 engages with the engagement portion 101*a* again to stop the partially toothed gear 101.

When the partially toothed gear 101 is controlled so as to rotate one revolution, a gear 117 that meshes with the partially toothed gear 101 also rotates. Accordingly, the feed roller 54 is rotated by the shaft 114, which is connected to the gear 117. By adequately setting the gear ratio between the partially toothed gear 101 and the gear 117, the feed roller 54 can be rotated several revolutions while the partially toothed gear 101 rotates one revolution. Thus, the sheet S that is being fed can be conveyed to the pair of conveying rollers 56 that are positioned downstream. A one-way clutch is disposed in a bearing 118 provided on the shaft 114. The one-way clutch allows the rotation of the shaft 114 when the shaft 114 rotates the feed roller 54 in the feeding direction, but locks the rotation of the shaft 114 when the shaft 114 tries to rotate the feed roller 54 in the direction opposite to the feeding direction. Thus, the feed roller 54 is prevented from rotating in the direction opposite to the feeding direction. Here, the state in which a "roller rotates in the feeding direction" is the state in which the roller is rotated in a direction for conveying the sheet toward an image forming unit in the LBP 1.

A gear 111 in which a one-way clutch is provided is disposed between the shaft 114 and the feed roller 54. When the shaft 114 rotates in a direction for rotating the feed roller 54 in the feeding direction, the one-way clutch provided in the gear 111 locks the shaft 114 and the feed roller 54 to each other so that the feed roller 54 also rotates. However, after the single revolution of the partially toothed gear 101 has been finished and the shaft 114 has been stopped, the one-way clutch slips when the feed roller 54 is rotated in the feeding direction by the movement of the sheet that is being fed. Therefore, the rotation of the feed roller 54 caused by the movement of the sheet is not transmitted to the gear 117 or the partially toothed gear 101. The rotation of the feed roller 54 is transmitted to the pickup roller 53 through the gear 111 and gears 112 and 113. Therefore, when the feed roller 54 rotates in the feeding direction, the pickup roller 53 also rotates in the feeding direction. In other words, the feed roller 54 and the pickup roller 53 are connected to each other by the gears 111, 112, and 113 such that the feed roller 54 and the pickup roller 53 rotate in the same direction.

Reference numeral 110 denotes the pickup motor for raising and lowering the pickup roller 53 that is arranged to be vertically movable. The pickup motor 110 includes a rack 109 that is vertically slidable and a gear portion that meshes with the rack 109. The rack 109 is engaged with an end portion 115*b* of the roller holder 115 that holds the pickup roller 53. When the rack 109 slides upward, the end portion 115*b* is raised and the roller holder 115 is raised accordingly. The pickup roller 53 can be raised by driving the pickup motor 110 so as to move the rack 109. Thus, the pickup roller 53 can be moved away from the top surface of the uppermost sheet S.

The drive connection mechanism that connects the shaft 105 to the retard roller 55 will now be described.

A gear 106 is bonded to the shaft 105, and is configured to rotate together with the shaft 105 when the shaft 105 rotates. The driving force is transmitted to the retard roller 55 through the gear 106, gears 107 and 131, and a shaft 119. The retard roller 55 is structured such that the retard roller 55 can be moved away from the feed roller 54, and is pressed against the feed roller 54 by a spring (not shown) at a predetermined pressure. A universal joint 132 is provided at an intermediate position of the shaft 119 so that the driving force can be transmitted even if the retard roller 55 is separated from the feed roller 54 when the sheet reaches the nip position. A substantially constant driving force is constantly applied to the retard roller 55 in the direction opposite to the feeding direction in accordance with the transmitting driving force (limit value) of the torque limiter provided in the limiter gear 104.

Next, a rotation detection mechanism used to detect whether the retard roller 55 is rotating or stationary will be described with reference to FIGS. 1 and 2B. Reference numeral 122 denotes a rotation detection lever that is connected to the shaft 119, to which the retard roller 55 is connected, and that rotates together with the shaft 119. The rotation detection lever 122 transmits or blocks light in the rotation detection sensor 121. Therefore, when the retard roller 55 is being rotated, the light is repeatedly transmitted and blocked by the rotation detection lever 122 in the rotation detection sensor 121. The rotation detection sensor 121 is an optical sensor, and outputs a signal depending on whether the light is transmitted or blocked by the rotation detection lever 122.

Reference numeral 123 denotes a rotational direction detection lever that is urged against a side surface of the rotation detection lever 122 by a compression spring 124. The rotational direction detection lever 123 transmits the light in the rotation detection sensor 121 when the retard roller 55 is rotating in the feeding direction. When the retard roller 55 is rotating in the direction opposite to the feeding direction, the rotational direction detection lever 123 is rotated by the frictional force between the rotational direction detection lever 123 and the side surface of the rotation detection lever 122, and blocks the light in the rotation detection sensor 121. Owing to the combination of the above-described two levers 122 and 123, when the retard roller 55 is rotating in the feeding direction, the light is repeatedly transmitted and blocked in the rotation detection sensor 121. In addition, owing to the combination of the two levers 122 and 123, when the retard roller 55 is rotating in the reverse direction or is stationary, the state in which the light is transmitted or blocked in the rotation detection sensor is maintained. Therefore, the control unit C can determine whether or not the retard roller 55 is rotating in the feeding direction on the basis of the signal from the rotation detection sensor 121.

The sequence of the sheet feeding operation performed by the sheet feeding apparatus according to the present embodiment will now be described. When the sheet feeding signal is transmitted from the LBP 1, the drive motor 100 transmits a driving force to the retard roller 55 in the direction opposite to the feeding direction through the limiter gear 104 and a driving-force transmitting mechanism. At this time, the rotation of the feed roller 54 in the direction opposite to the feeding direction is locked by the one-way clutch provided in the bearing 118. Therefore, the retard roller 55 is restrained from rotating by the feed roller 54 and is stopped while the transmitting driving force is applied to the retard roller 55 by the torque limiter in the limiter gear 104.

In this state, the lever member 102 of the solenoid 103 releases the partially toothed gear 101, so that the feed roller 54 and the pickup roller 53 are rotated in the feeding direction by the partially toothed gear 101. When the feed roller 54 is rotated in the feeding direction, the retard roller 55 is also rotated in the feeding direction since the force applied by the feed roller 54 is larger than the transmitting driving force (limit value) of the torque limiter in the limiter gear 104. Then, when the rotation detection sensor 121 detects that the retard roller 55 is rotating in the feeding direction, the pickup motor 110 is rotated in the direction for moving the rack 109 downward. Accordingly, the pickup roller 53, which is being rotated, is brought into contact with the uppermost one of the sheets stacked on the intermediate plate 201 and the uppermost sheet S1 is conveyed.

The sheet feeding operation differs between the case in which sheets with a small coefficient of friction are successively fed and the case in which sheets with a large coefficient of friction are successively fed. Therefore, each of these cases will be described with reference to FIGS. 4A to 4C and 5A to 5C.

Figure 4A:
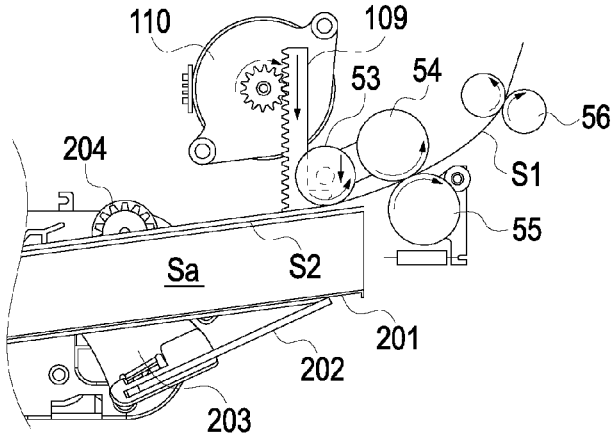
FIGS. 4A to 4C show diagrams illustrating the operation of the sheet feeding apparatus according to the first embodiment.

First, the case in which sheets with a small coefficient of friction are successively fed will be described. In the case where the coefficient of friction between the uppermost sheet S1 and the next sheet S2 positioned thereunder on the intermediate plate 201 is small, only the uppermost sheet S1 is conveyed by the pickup roller 53 to the nip position between the feed roller 54 and the retard roller 55, as illustrated in FIG. 4A. Then, the sheet is conveyed to the pair of conveying rollers 56 by the feed roller 54 and the retard roller 55 which is rotated by the movement of the sheet. Then, after a single revolution of the partially toothed gear 101, the transmission of the driving force to the feed roller 54 is stopped, and the feed roller 54 and the retard roller 55 are rotated in the sheet feeding direction by the movement of the sheet S1 conveyed by the pair of conveying rollers 56.

Figure 4B:
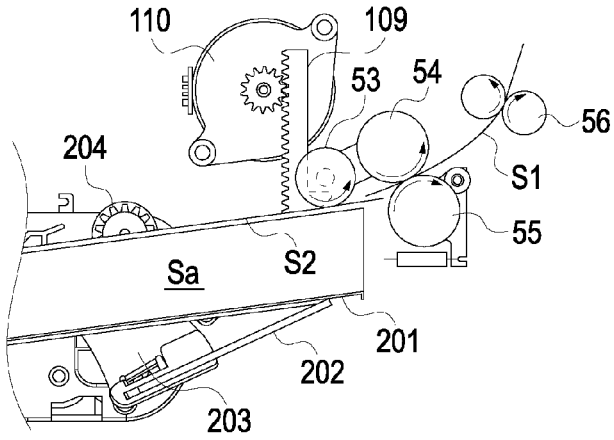

Then, when the trailing end of the sheet S1 leaves the pickup roller 53, the pickup roller 53 comes into contact with the next sheet S2, as illustrated in FIG. 4B. At this time, the sheet S1 that is being conveyed by the pair of conveying rollers 56 is nipped between the feed roller 54 and the retard roller 55. Therefore, the feed roller 54 and the retard roller 55 are rotated in the feeding direction. Since the rotation of the feed roller 54 is transmitted to the pickup roller 53 and the pickup roller 53 is set to the sheet feeding state, when the trailing end of the sheet S1 leaves the pickup roller 53, the pickup roller 53 starts conveying the next sheet S2. Accordingly, the sheet S1 and the sheet S2 are conveyed without an interval therebetween.

Figure 4C:
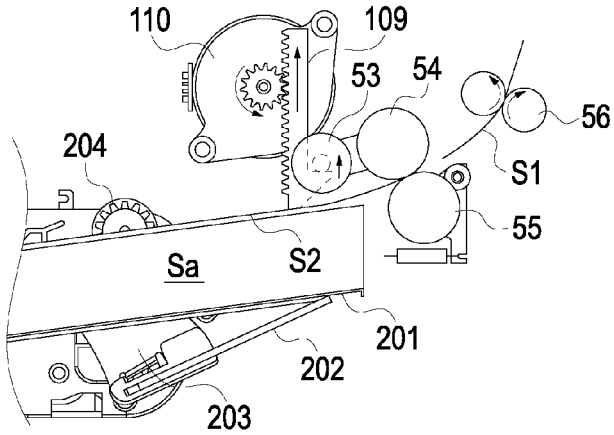

Then, when the trailing end of the sheet S1 leaves the nip position between the feed roller 54 and the retard roller 55, the rotation of the retard roller 55 stops. The rotation detection sensor 121 detects the stoppage of the retard roller 55 and outputs a signal. Then, the control unit C causes the pickup motor 110 to rotate in a direction for moving the rack 109 upward. Accordingly, the roller holder 115 is rotated and the pickup roller 53 is moved away from the sheet S2 so that the pickup roller 53 is set to a sheet non-feeding state. At this time, as illustrated in FIG. 4C, the next sheet S2 is stopped at a position where the leading end thereof is at the nip position between the feed roller 54 and the retard roller 55. If the sheets are fed by repeating the above-described process, the sheet feeding operation is always started while the leading end of the sheet to be fed is at the nip position between the feed roller 54 and the retard roller 55.

Figure 5A:
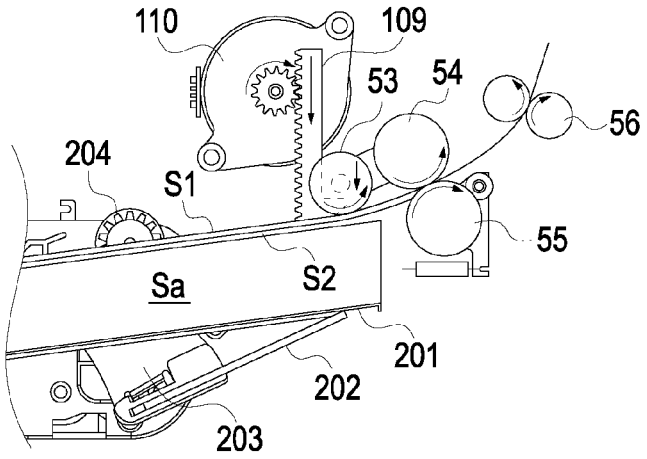
FIGS. 5A to 5C shows diagrams illustrating the operation of the sheet feeding apparatus according to the first embodiment.
Figure 5B:
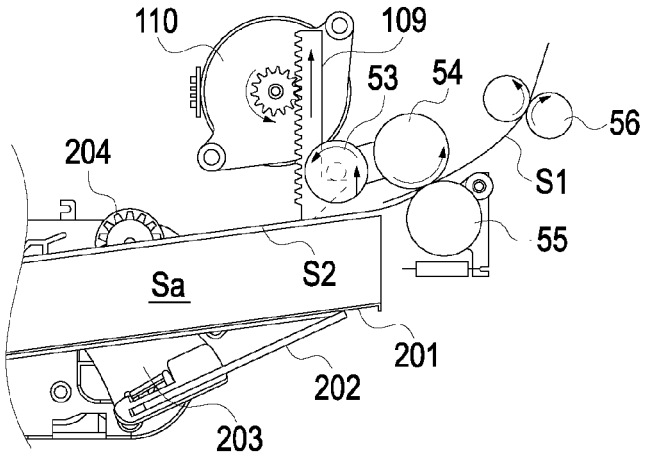
Figure 5C:
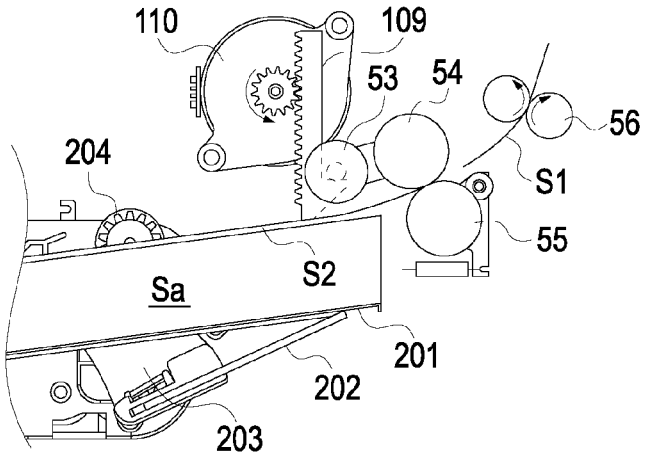

Next, the case in which sheets with a large coefficient of friction are successively fed will be described with reference to FIGS. 5A to 5C. In the case where the coefficient of friction between the uppermost sheet S1 and the next sheet S2 positioned thereunder is large, when the sheet S1 is conveyed, the sheet S2 is conveyed together with the sheet S1 to the nip position between the feed roller 54 and the retard roller 55 by the frictional force between the sheets, as illustrated in FIG.

5A. When the sheets S1 and S2 are conveyed to the nip position between the feed roller 54 and the retard roller 55, the retard roller 55 is rotated in the direction opposite to the feeding direction to separate the sheets S1 and S2 from each other. Accordingly, only the sheet S1 is conveyed further downstream. Then, when the rotation detection sensor 121 detects that the retard roller 55 has stopped in response to the separation of the sheets, the pickup motor 110 is rotated in the direction for moving the rack 109 upward, as illustrated in FIG. 5B. Accordingly, the pickup roller 53 is moved away from the sheet by the operations of the rack 109 and the roller holder 115 and the pickup roller 53 is set to the sheet non-feeding state. After the sheet S1 is conveyed, the leading end of the sheet S2 to be fed next is stopped at the nip position between the feed roller 54 and the retard roller 55, as illustrated in FIG. 5C. Also in this case, the above-described process is repeated so that the sheet feeding operation for the next sheet S2 is always started while the leading end of the sheet is at the nip position between the feed roller 54 and the retard roller 55, as illustrated in FIG. 5C.

As described above, irrespective of whether the coefficient of friction between the uppermost sheet S1 that is to be fed and the next sheet S2 positioned thereunder is small or large, the leading end of the sheet S2 to be fed next is always at the nip position between the feed roller 54 and the retard roller 55. Therefore, the variation in the position of the leading end of each sheet in the sheet feeding operation can be minimized or eliminated, and the stability of the sheet feeding operation can be increased. Accordingly, in the case where the sheets are successively fed, the intervals between the sheets can be made uniform at a minimum interval, and the productivity can be increased. Also in the case where sheets having different coefficients of friction are mixed, one of the above-described sheet feeding operations is performed in accordance with the coefficient of friction between the sheet being fed and the next sheet. Therefore, the sheet S2 to be fed next can be positioned at the nip position between the feed roller 54 and the retard roller 55.

Modification of First Embodiment

Figure 6A:
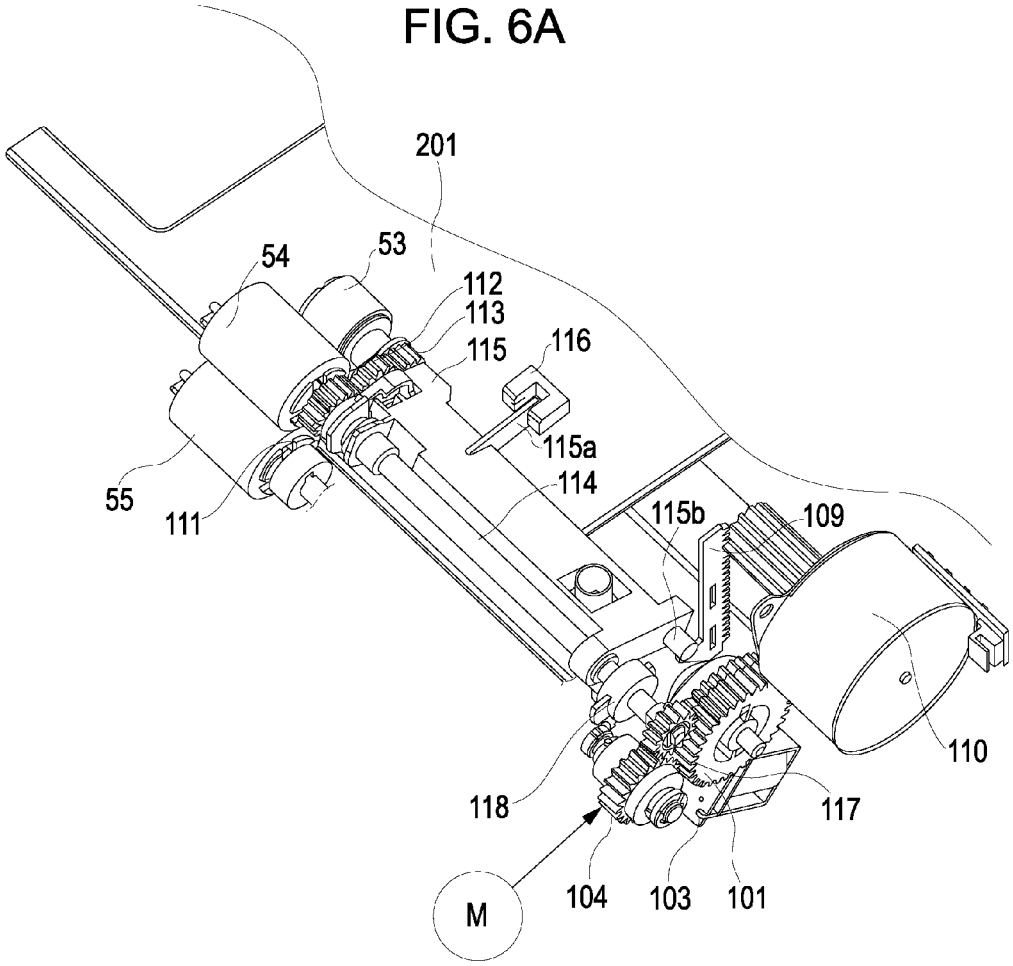
FIGS. 6A and 6B show a perspective view of a sheet feeding section of a sheet feeding apparatus according to a modification of the first embodiment.
Figure 6B:
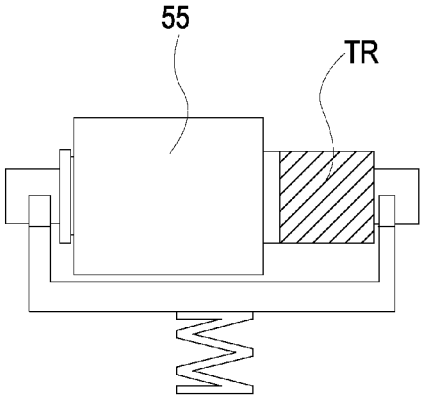

In the above-described first embodiment, the retard roller 55 receives a driving force that causes the retard roller 55 to rotate in the direction opposite to the feeding direction. However, a non-driven separation roller which does not receive the driving force in the direction opposite to the feeding direction and which is simply provided with a torque limiter may be used, as in the following example. FIGS. 6A and 6B show a non-driven separation roller. FIG. 6A is a perspective view of a sheet feeding section of a sheet feeding apparatus including the non-driven separation roller. FIG. 6B is a front view illustrating the structure of the separation roller.

The sheet feeding section in this embodiment differs from that illustrated in FIG. 1 in that the driving-force transmitting mechanism for transmitting the driving force to the retard roller 55 is omitted. In addition, a separation roller 55 is provided in place of the retard roller. As illustrated in FIG. 6B, the separation roller 55 is rotatably supported by a shaft with a torque limiter TR interposed therebetween, and is pressed against the feed roller 54. A rotation detection mechanism for detecting the rotational state of the separation roller 55 is provided. The rotation detection mechanism may be the combination of the rotation detection lever 122 and the rotation detection sensor 121 used in the structure of the first embodiment. When there is no sheet between the separation roller 55 and the feed roller 54 or when there is only one sheet between the separation roller 55 and the feed roller 54, the separation roller 55 is set to a rotatable state by the torque limiter and is rotated by the feed roller 54 or by the sheet that is being conveyed. When there are two or more sheets between the separation roller 55 and the feed roller 54, the separation roller 55 is stopped by the torque limiter. Accordingly, only the sheet that is in contact with the feed roller 54 is conveyed while the other sheets are stopped at the nip position.

The operation of the sheet feeding apparatus according to this embodiment is similar to that of the sheet feeding apparatus of the first embodiment (illustrated in FIG. 1), and differs only in that the separation roller stops when two or more sheets are fed by the pickup roller 53. Since the sheet feeding operation is similar to that in the first embodiment, explanations thereof are omitted.

The non-driven separation roller may also be applied to embodiments described below.

Second Embodiment

Next, a second embodiment of the present invention will be described. The second embodiment differs from the first embodiment in that the pickup roller 53 is moved away from the sheet Sa by vertically moving the intermediate plate 201 instead of vertically moving the pickup roller 53. Therefore, the roller holder 115 is fixed at a sheet feeding position. Accordingly, the mechanism for vertically moving the roller holder 115 in the first embodiment, that is, the rack 109 and the pickup motor 110, are not used. Other structures of the present embodiment are similar to those of the first embodiment. Therefore, components similar to those in the first embodiment are denoted by the same reference numerals, and detailed explanations thereof are thus omitted.

FIGS. 9A to 9C and 10A to 10C illustrate the sheet feeding operation according to the present embodiment. Similar to the first embodiment, the sheet feeding operation differs depending on whether the coefficient of friction between the uppermost sheet S1 and the next sheet S2 positioned thereunder on the sheet feeding cassette is small or large. Therefore, the operation in each case will be described.

Figure 9A:
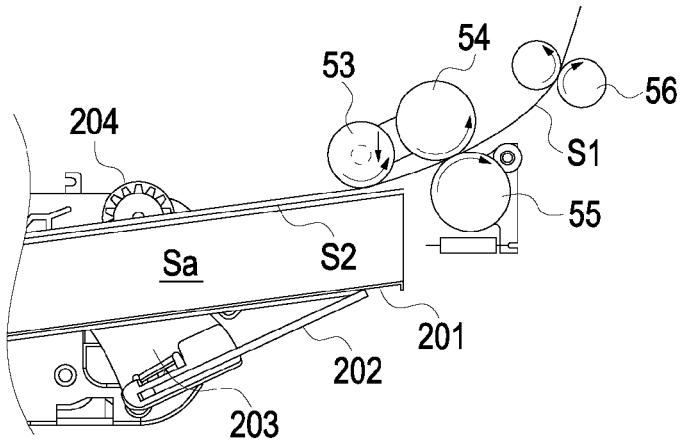
FIGS. 9A to 9C are diagrams illustrating the operation of a sheet feeding apparatus according to a second embodiment.

First, the case in which sheets with a small coefficient of friction are successively fed will be described. In the case where the coefficient of friction between the uppermost sheet S1 and the next sheet S2 positioned thereunder on the intermediate plate 201 is small, only the uppermost sheet S1 is conveyed to the nip position between the feed roller 54 and the retard roller 55, as illustrated in FIG. 9A. Then, the sheet is conveyed to the pair of conveying rollers 56 by the feed roller 54 and the retard roller 55 which is rotated by the movement of the sheet that is being conveyed. Then, after a single revolution of the partially toothed gear 101, the transmission of the driving force to the feed roller 54 is stopped. The sheet S1 is conveyed by the pair of conveying rollers 56, and the feed roller 54 and the retard roller 55 are rotated in the feeding direction by the movement of the sheet S1 that is being conveyed.

Figure 9B:
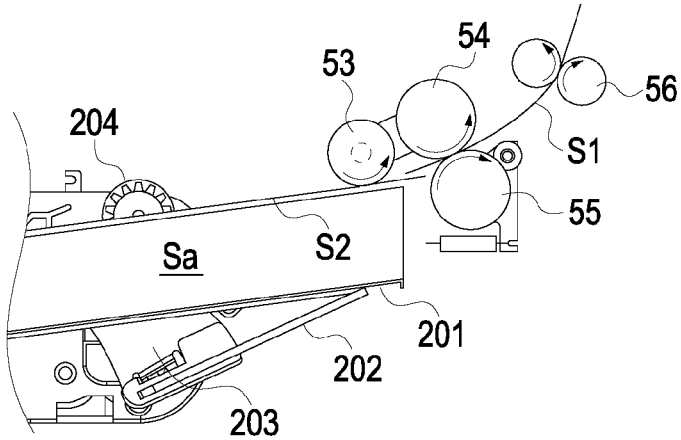

Then, when the trailing end of the sheet S1 leaves the pickup roller 53, the pickup roller 53 comes into contact with the next sheet S2 positioned under the sheet S1, as illustrated in FIG. 9B. At this time, the sheet S1 that is being conveyed by the pair of conveying rollers 56 is nipped between the feed roller 54 and the retard roller 55. Therefore, the feed roller 54 and the retard roller 55 are being rotated in the feeding direction. Thus, the pickup roller 53 is in the sheet feeding state. When the trailing end of the sheet S1 leaves the pickup roller 53, the pickup roller 53 starts conveying the next sheet S2 that is positioned under the sheet S1. Accordingly, the sheet S1 and the sheet S2 are conveyed without an interval therebetween.

Figure 9C:
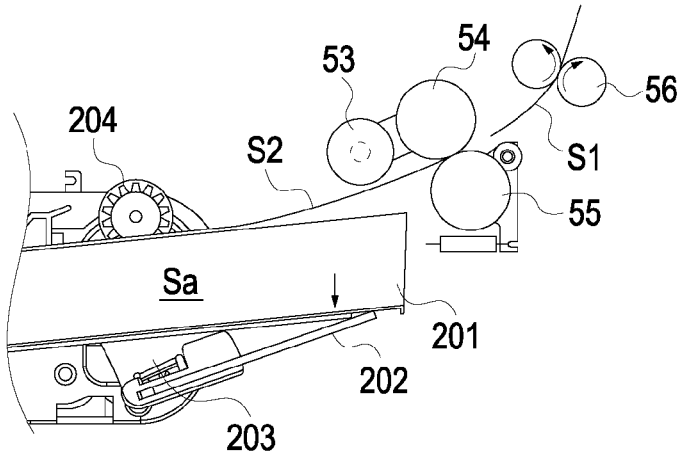

Then, when the trailing end of the sheet S1 leaves the nip position between the feed roller 54 and the retard roller 55, the rotation of the retard roller 55 stops and the rotation detection sensor 121 detects the stoppage. Then, the lift motor 210 that raises and lowers the intermediate plate 201 is rotated in the reverse direction by a certain amount in response to a detection signal from the rotation detection sensor 121, so that the pickup roller 53 and the sheet S2 on the intermediate plate 201 are moved away from each other. At this time, as illustrated in FIG. 9C, the next sheet S2 is stopped at a position where the leading end thereof is at the nip position between the feed roller 54 and the retard roller 55. If the sheets are fed by repeating the above-described process, the sheet feeding operation is always started while the leading end of the sheet to be fed is at the nip position between the feed roller 54 and the retard roller 55.

Figure 10A:
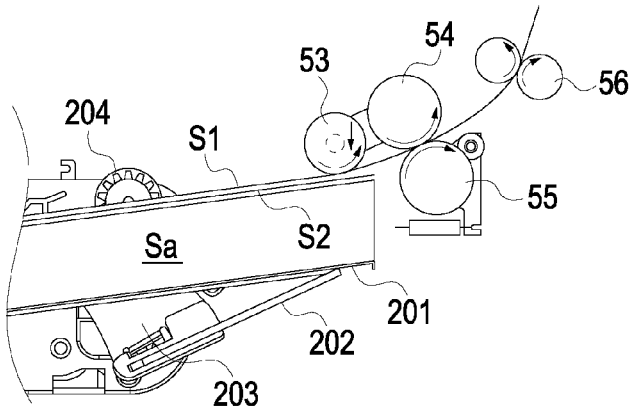
FIGS. 10A to 10C are diagrams illustrating the operation of the sheet feeding apparatus according to the second embodiment.
Figure 10B:
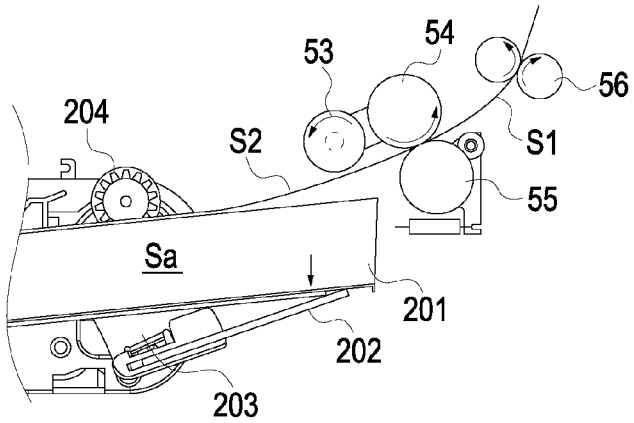
Figure 10C:
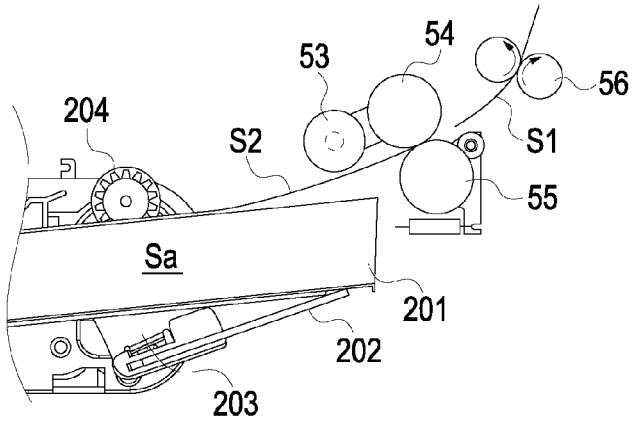

Next, the case in which sheets with a large coefficient of friction are successively fed will be described. In the case where the coefficient of friction between the uppermost sheet S1 and the next sheet S2 positioned thereunder is large, when the sheet S1 is conveyed, the sheet S2 is also conveyed to the nip position between the feed roller 54 and the retard roller 55 by the frictional force between the sheets S1 and S2, as illustrated in FIG. 10A. Then, when the sheets S1 and S2 are conveyed to the nip position between the feed roller 54 and the retard roller 55, the retard roller 55 is rotated in the direction opposite to the feeding direction to separate the sheets S1 and S2 from each other. Accordingly, only the sheet S1 is further conveyed. Then, when the rotation detection sensor 121 detects that the retard roller 55 has stopped in response to the separation of the sheets, the lift motor 210 that raises and lowers the intermediate plate 201 is rotated in the reverse direction by a certain amount, as illustrated in FIG. 10B. Accordingly, the pickup roller 53 and the sheet S2 on the intermediate plate 201 are moved away from each other and the pickup roller 53 is set to the sheet non-feeding state. After the sheet S1 is conveyed, the leading end of the sheet S2 to be fed next is stopped at the nip position between the feed roller 54 and the retard roller 55, as illustrated in FIG. 10C. Also in this case, the above-described process is repeated so that the sheet feeding operation for the next sheet is always started while the leading end of the sheet is at the nip position between the feed roller 54 and the retard roller 55, as illustrated in FIG. 10C.

As described above, irrespective of whether the coefficient of friction between the uppermost sheet S1 that is to be fed and the sheet S2 positioned thereunder is small or large, the leading end of the sheet S2 to be fed next is always at the nip position between the feed roller 54 and the retard roller 55. Also in the case where sheets having different coefficients of friction are mixed, one of the above-described sheet feeding operations is performed in accordance with the coefficient of friction between the sheet being fed and the next sheet, so that the leading end of the next sheet is positioned at the nip position between the feed roller 54 and the retard roller 55. Therefore, effects similar to those of the first embodiment can be obtained.

Third Embodiment

Next, a third embodiment of the present invention will be described. The present embodiment differs from the first and second embodiments in that a structure for linking the rotation of the pickup roller and the rotation of the retard roller to each other is provided. To link the rotations, a gear train for driving the pickup roller and a gear train for driving the retard roller are connected to each other. To optimize the drive train, the torque limiter, which is disposed coaxially with the retard roller in the above-described examples, is disposed coaxially with the shaft of the feed roller. The pickup roller is constantly in contact with the uppermost one of the sheets stacked on the sheet feeding cassette. Components similar to those in the first and second embodiments are denoted by the same reference numerals, and detailed explanations thereof are thus omitted.

Figure 11:
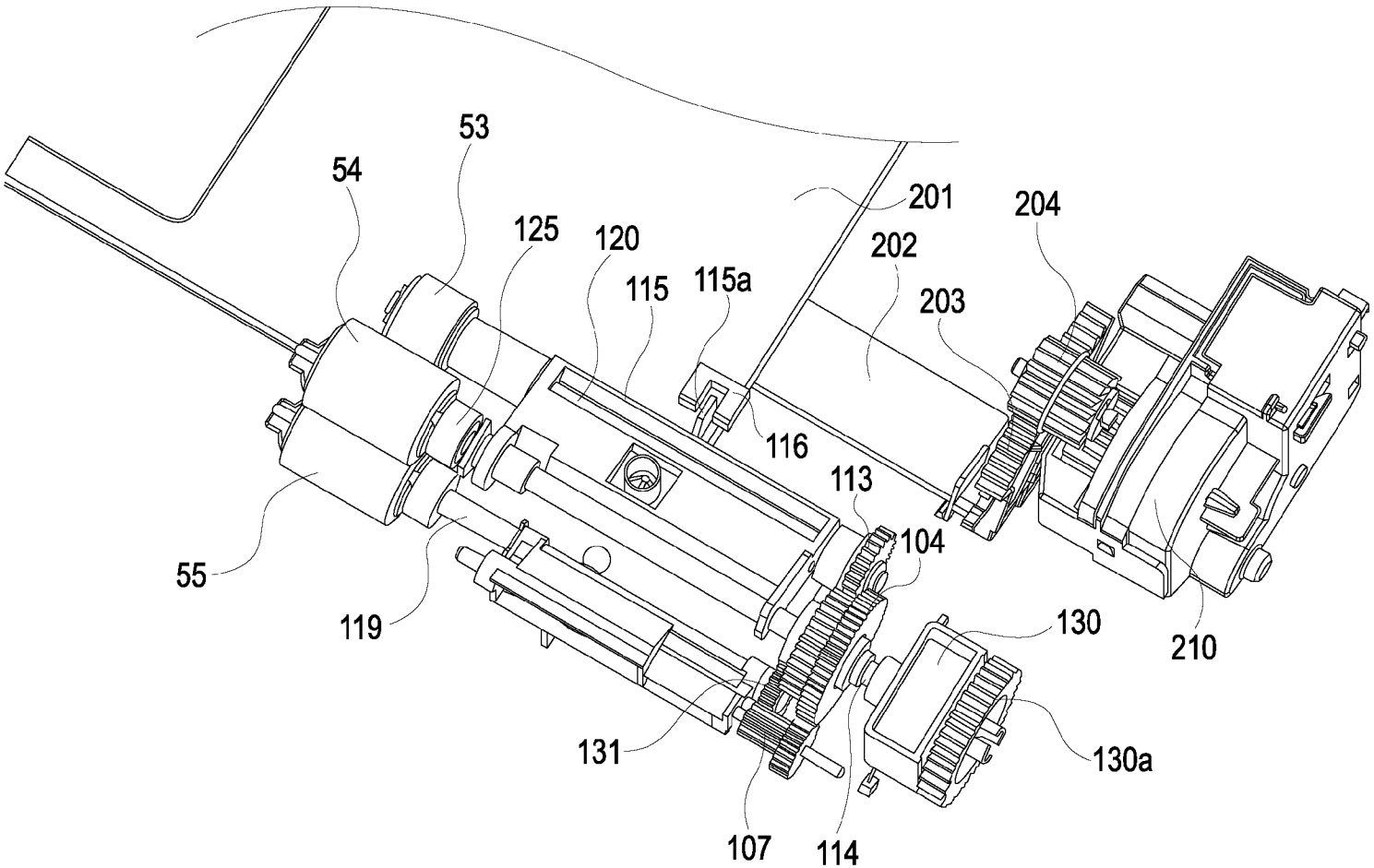
FIG. 11 is a perspective view of a sheet feeding apparatus according to a third embodiment of the present invention.

A drive connection mechanism according to the present embodiment will be described with reference to FIG. 11. Reference numeral 130 denotes an electromagnetic clutch which includes a gear portion 130*a* to which a driving force of the drive motor 100 is transmitted. The electromagnetic clutch 130 is connected to the shaft 114, to which the feed roller 54 is connected with a connecting member 125 interposed therebetween. When the electromagnetic clutch 130 is in an engaged state, the driving force of the drive motor 100 is transmitted to the shaft 114, and is then transmitted to the feed roller 54 through the connecting member 125 so that the feed roller 54 is rotated.

The shaft 114 is engaged with a limiter gear 104 with a torque limiter, which is provided in the limiter gear 104, interposed therebetween. The gear 104 meshes with a gear 107, and the gear 107 meshes with a gear 131. The gears 104, 107, and 131 are configured to transmit rotation to the retard roller 55. The retard roller 55 constantly receives a constant driving force in the direction opposite to the feeding direction by the torque limiter provided in the limiter gear 104. When the load applied to the retard roller 55 is smaller than the transmitting driving force (limit value), the torque limiter in the limiter gear 104 transmits the driving force of the drive motor 100 to the retard roller 55 to rotate the retard roller 55 in the direction opposite to the feeding direction. If the load applied to the retard roller 55 is larger than the transmitting driving force (limit value), the torque limiter slips while a certain driving force is continuously applied between the limiter gear 104 and the shaft 114.

In the state in which the electromagnetic clutch 130 is disengaged, if the feed roller 54 is rotated in the feeding direction by the movement of the sheet that is being fed, the electromagnetic clutch 130 slips. At this time, the rotation of the feed roller 54 is transmitted to the retard roller 55 through the torque limiter provided in the limiter gear 104, and the retard roller 55 is rotated in the direction opposite to the feeding direction.

The limiter gear 104 is formed as a stepped gear, and a small-diameter gear portion of the limiter gear 104 meshes with the gear 113. The gear 113 is connected to a shaft 120 to which the pickup roller 53 is connected, so that the driving force is transmitted to the pickup roller 53 through the gear 113 and the shaft 120. The gear 113 is provided with a one-way clutch. When the retard roller 55 is rotated in the direction opposite to the feeding direction by the rotation of the limiter gear 104, the gear 113 slips and the rotation is not transmitted to the pickup roller 53. When the retard roller 55 is rotated in the feeding direction, the one-way clutch provided in the gear 113 locks the shaft 120 so that the rotation in the feeding direction is transmitted to the pickup roller 53.

The sequence of the sheet feeding operation according to the present embodiment will now be described. When the sheet feeding signal is transmitted from the LBP, the electromagnetic clutch 130 is set to the engaged state and the shaft 114 is rotated. Accordingly, the feed roller 54 is also rotated in the feeding direction. At this time, owing to the torque limiter in the limiter gear 104, the rotation of the drive motor 100 is not transmitted to the retard roller 55. Therefore, the retard roller 55 is rotated in the feeding direction by the rotation of the feed roller 54. The rotation of the retard roller 55 is transmitted to the pickup roller 53 through the limiter gear 104 and the gear 113, so that the pickup roller 53 is rotated in the feeding direction. Accordingly, the uppermost sheet S1 on the intermediate plate 201 is conveyed.

The sheet feeding operation differs between the case in which sheets with a small coefficient of friction are successively fed and the case in which sheets with a large coefficient of friction are successively fed. Therefore, each of these cases will be described with reference to FIGS. 12A to 12C and 13A to 13C.

Figure 12A:
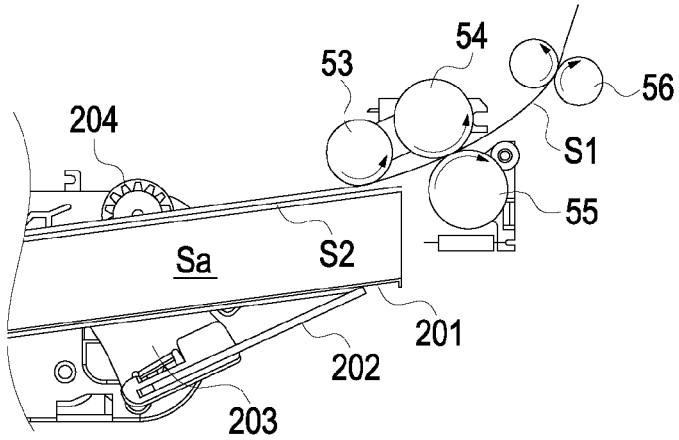
FIGS. 12A to 12C are diagrams illustrating the operation of the sheet feeding apparatus according to the third embodiment.
Figure 12B:
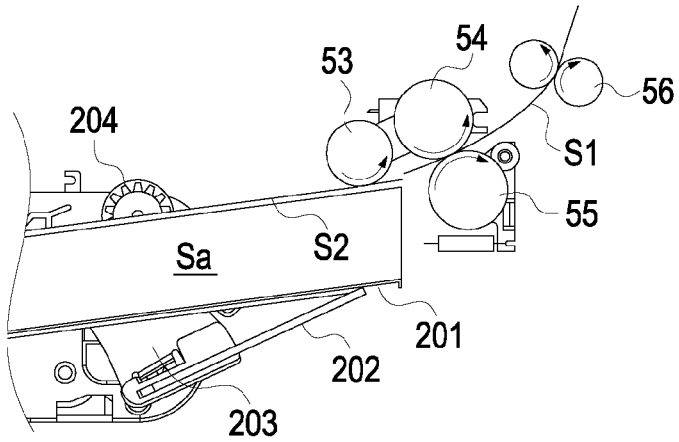

First, the case in which sheets with a small coefficient of friction are successively fed will be described. In the case where the coefficient of friction between the uppermost sheet S1 and the next sheet S2 positioned thereunder on the intermediate plate 201 is small, only the uppermost sheet S1 is conveyed to the nip position between the feed roller 54 and the retard roller 55, as illustrated in FIG. 12A. Then, the sheet is conveyed to the pair of conveying rollers 56 by the feed roller 54 and the retard roller 55 which is rotated by the movement of the sheet. When the sheet S1 reaches the pair of conveying rollers 56 and the pair of conveying rollers 56 start to convey the sheet S1, the electromagnetic clutch 130 is disengaged and the transmission of the driving force to the feed roller 54 is stopped. At this time, the feed roller 54 and the retard roller 55 are rotated in the feeding direction by the sheet S1 that is being conveyed by the pair of conveying rollers 56. Then, when the trailing end of the sheet S1 leaves the pickup roller 53, the pickup roller 53 comes into contact with the next sheet S2 positioned under the sheet S1, as illustrated in FIG. 12B.

Figure 12C:
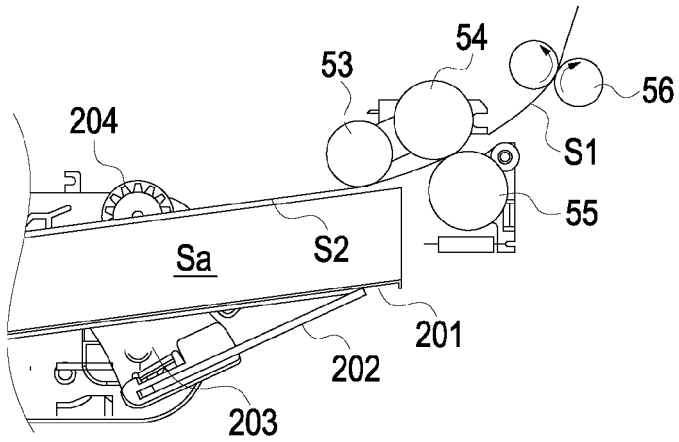

At this time, the sheet S1 that is being conveyed by the pair of conveying rollers 56 is nipped between the feed roller 54 and the retard roller 55. Therefore, the retard roller 55 is rotated in the feeding direction. The rotation of the retard roller 55 in the feeding direction is transmitted to the pickup roller 53 by the limiter gear 104 and the gear 113. Therefore, the pickup roller 53 is also rotated in the feeding direction. Therefore, although the electromagnetic clutch 130 is disengaged and the rotation of the drive motor 100 is not transmitted, the pickup roller 53 continuously rotates even after the trailing end of the sheet S1 leaves the pickup roller 53. Therefore, the next sheet S2 is conveyed without an interval between the sheets S1 and S2. Then, when the trailing end of the sheet S1 leaves the nip position between the feed roller 54 and the retard roller 55, the rotation of the retard roller 55 stops and the rotation of the pickup roller 53 stops accordingly. Therefore, as illustrated in FIG. 12C, the next sheet S2 is stopped at a position where the leading end thereof is at the nip position between the feed roller 54 and the retard roller 55. If the sheets are fed by repeating the above-described process, the leading end of the sheet next to the sheet that is being fed always stops at the nip position between the feed roller 54 and the retard roller 55. Accordingly, the sheet feeding operation is always started from the state in which the leading end of the sheet to be fed is at the nip position between the feed roller 54 and the retard roller 55.

Figure 13A:
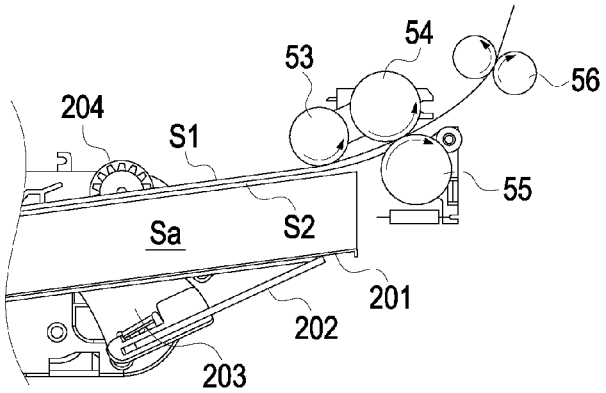
FIGS. 13A to 13C are diagrams illustrating the operation of the sheet feeding apparatus according to the third embodiment.

Next, the case in which sheets with a large coefficient of friction are successively fed will be described. It is assumed that the coefficient of friction between the uppermost sheet S1 and the next sheet S2 positioned thereunder is large. When the sheet feeding signal is transmitted, the electromagnetic clutch 130 is set to the engaged state. Then, when the sheet S1 is conveyed, the sheet S2 is also conveyed to the nip position between the feed roller 54 and the retard roller 55 by the frictional force between the sheets S1 and S2, as illustrated in FIG. 13A. Then, when the sheets S1 and S2 reach the nip position, the retard roller 55 rotates in the direction opposite to the feeding direction to separate the sheets S1 and S2 from each other, so that only the sheet S1 is further conveyed. When the pair of conveying rollers 56 start to convey the sheet S1, the electromagnetic clutch 130 is disengaged and the transmission of the driving force to the feed roller 54 is stopped.

Figure 13B:
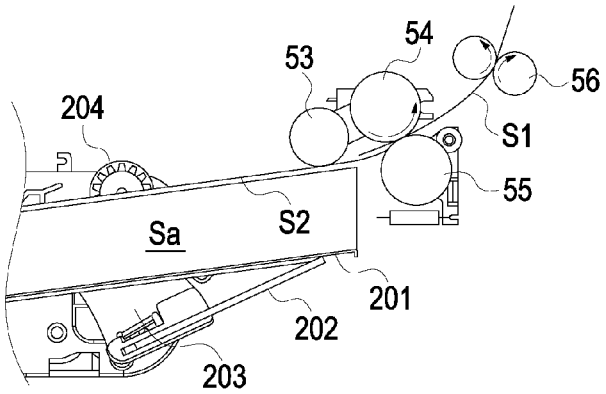
Figure 13C:
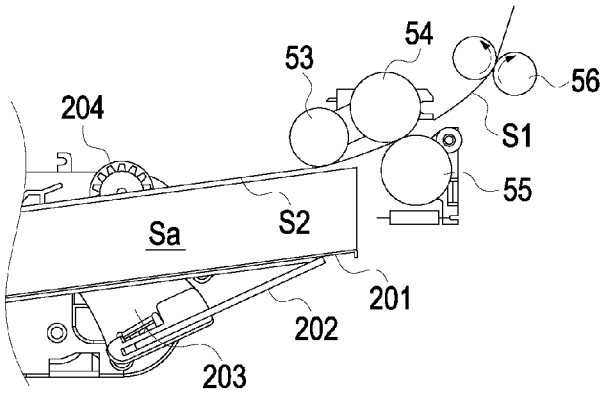

After the trailing end of the sheet S1 leaves the nip position between the feed roller 54 and the retard roller 55, the leading end of the sheet S2 to be fed next is stopped at the nip position between the feed roller 54 and the retard roller 55, as illustrated in FIG. 13B. At this time, the rotation of the retard roller 55 is stopped since the retard roller 55 is pressed against the feed roller 54 that is stationary. Therefore, no rotation is transmitted to the pickup roller 53. Also in this case, the above-described process is repeated so that the sheet feeding operation for the next sheet is always started while the leading end of the sheet is at the nip position between the feed roller 54 and the retard roller 55, as illustrated in FIG. 13C.

As described above, irrespective of whether the coefficient of friction between the uppermost sheet S1 that is to be fed and the next sheet S2 positioned thereunder is small or large, the leading end of the sheet S2 to be fed next is always at the nip position between the feed roller 54 and the retard roller 55. Also in the case where sheets having different coefficients of friction are mixed, one of the above-described sheet feeding operations is performed in accordance with the coefficient of friction between the sheet being fed and the next sheet, so that the sheet to be fed next is at the nip position between the feed roller 54 and the retard roller 55. Therefore, effects similar to those of the first embodiment can be obtained.

Fourth Embodiment

Figure 14:
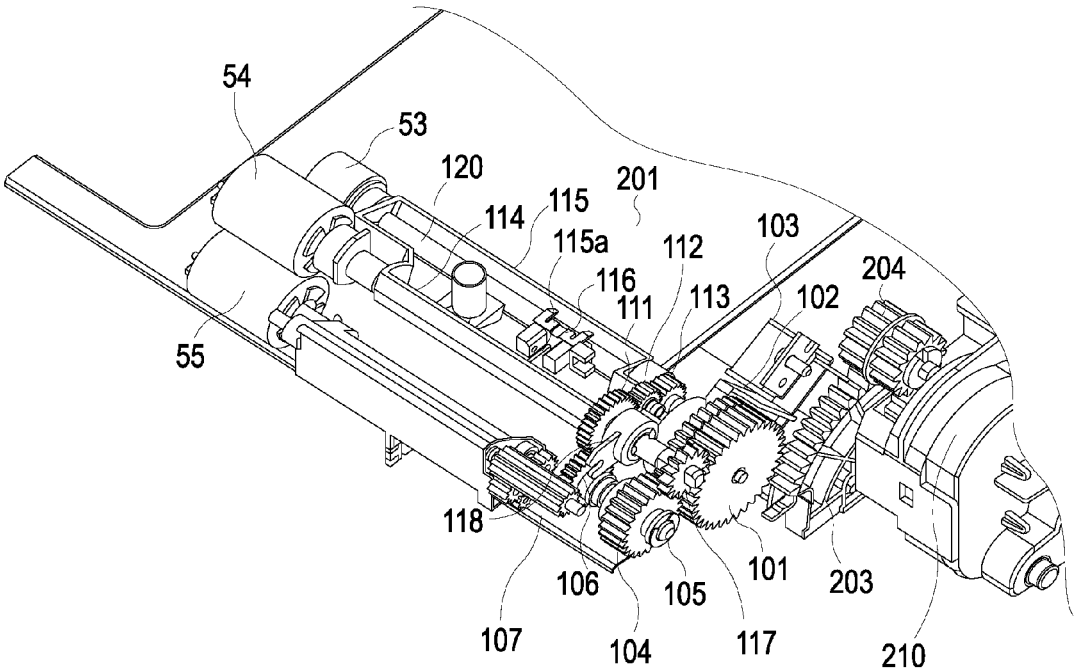
FIG. 14 is a perspective view of a sheet feeding apparatus according to a fourth embodiment of the present invention.

Next, a fourth embodiment of the present invention will be described. The fourth embodiment differs from the first and second embodiments in that a structure for linking the rotation of the pickup roller and the rotation of the retard roller to each other is provided. To link the rotations, a gear train for driving the pickup roller and a gear train for driving the retard roller are connected to each other. The fourth embodiment differs from the third embodiment in that means for bringing the pickup roller into contact with the uppermost sheet or moving the pickup roller away from the uppermost sheet is provided. The present embodiment is characterized by the timing at which the pickup roller is brought into contact with or moved away from the uppermost sheet during the sheet feeding operation. Components similar to those in the first and second embodiments are denoted by the same reference numerals, and detailed explanations thereof are thus omitted. A drive connection mechanism according to the fourth embodiment will be described with reference to FIG. 14. Structures different from those of the first embodiment illustrated in FIG. 1 will be described. Components similar to those in the first embodiment are denoted by the same reference numerals, and explanations thereof are thus omitted.

The pickup roller 53 is fixed to the shaft 120 that is supported in a rotatable manner. The gear 111 meshes with the gear 107, and the driving force is transmitted to the shaft 120 through the gears 112 and 113, so that the pickup roller 53 can be rotated. The gear 113 is provided with a one-way clutch. When the retard roller 55 is rotated in the direction opposite to the feeding direction by the transmitting driving force of the torque limiter, the gear 113 slips and the driving force is not transmitted to the pickup roller. When the retard roller is rotated in the feeding direction by a driving force larger than the transmitting driving force of the torque limiter, the one-way clutch provided in the gear 113 locks the shaft 120 so that the pickup roller 53 is also rotated in the feeding direction. The gears 111, 112, and 113 illustrated in FIG. 14 have the same functions as those of the gears 111, 112, and 113 illustrated in FIG. 1, and differ from the gears 111, 112, and 113 illustrated in FIG. 1 only in the positions at which they are arranged. Therefore, the gears are denoted by the same reference numerals.

Figure 15:
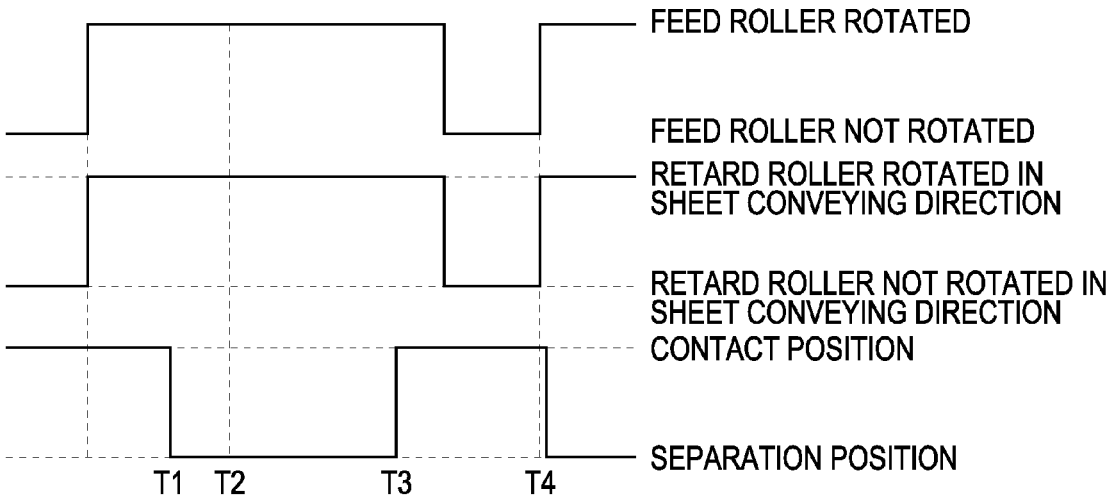
FIG. 15 is a timing chart of the operation of raising or lowering an intermediate plate according to the fourth embodiment.

The sequence of the sheet feeding operation according to the present embodiment will now be described with reference to FIGS. 15 and 16A to 16D. FIG. 15 is a timing chart illustrating the changes over time in the driving states of the feed roller 54 and the retard roller 55 and the vertical position of the intermediate plate 201. In the figure, the "contact position" corresponds to the state in which the intermediate plate 201 is raised to a position where the pickup roller 53 comes into contact with the uppermost sheet S1 on the intermediate plate 201. In addition, the "separation position" corresponds to the state in which the intermediate plate 201 is lowered to a position where the pickup roller 53 is separated from the uppermost sheet S1.

The sheet feeding operation differs depending on whether the coefficient of friction between the uppermost sheet S1 and the next sheet S2 positioned thereunder on the sheet feeding cassette is small or large. Therefore, the operation in each case will be described.

Figure 16A:
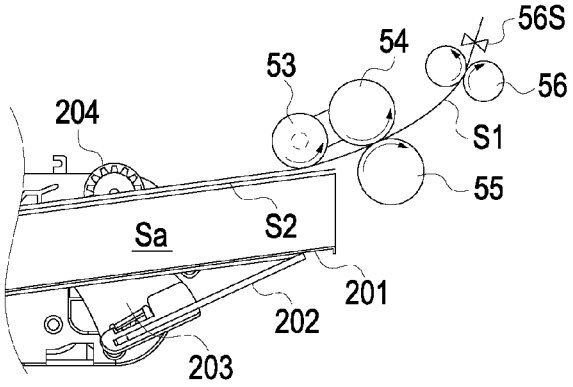
FIGS. 16A to 16D are diagrams illustrating the operation of the sheet feeding apparatus according to the fourth embodiment.

First, the case in which sheets with a small coefficient of friction are successively fed will be described. That is, the case in which the coefficient of friction between the uppermost sheet S1 and the next sheet S2 positioned thereunder on the intermediate plate 201 is small will be described. As illustrated in FIG. 16A, when the feeding signal is transmitted from the LBP, the drive motor 100 transmits the driving force to the retard roller 55 in the direction opposite to the feeding direction. At this time, the rotation of the feed roller 54 in the direction opposite to the feeding direction is locked by the one-way clutch provided in the bearing 118. Therefore, the retard roller 55 is restrained from rotating by the feed roller 54 and is stopped while the transmitting driving force is applied to the retard roller 55 by the torque limiter. In this state, the lever member 102 of the solenoid 103 releases the partially toothed gear 101, so that the feed roller 54 is rotated in the feeding direction by the partially toothed gear 101. When the feed roller 54 is rotated in the feeding direction, the retard roller 55 is also rotated in the feeding direction against the transmitting driving force of the torque limiter, owing to the force applied to the retard roller 55 by the feed roller 54.

Figure 16B:
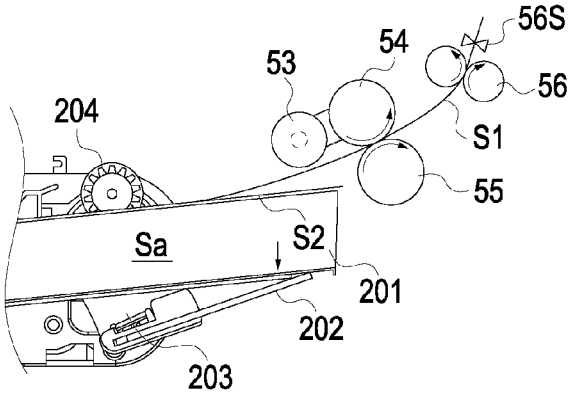

When the retard roller 55 rotates in the feeding direction, the rotation is transmitted to the pickup roller 53 through the gears 106, 111, 112, and 113, so that the pickup roller 53 also rotates in the feeding direction. Accordingly, only the sheet S1 is conveyed to the nip position between the feed roller 54 and the retard roller 55. When T1 is the time at which the sheet reaches the nip position, as illustrated in FIG. 15, the lift motor 210 is rotated by a certain amount so that the intermediate plate 201 starts to move downward at time T1. Accordingly, as illustrated in FIG. 16B, the pickup roller 53 and the sheet S1 are separated from each other. Then, the sheet S1 is conveyed to the pair of conveying rollers 56 by the feed roller 54, and the leading end of the sheet passes through a conveyance sensor 56S, which is an optical sensor disposed on the sheet conveying path. The time at which the leading end of the sheet passes through the sensor is defined as T2. Then, after a single revolution of the above-described partially toothed gear 101, the transmission of the driving force to the feed roller 54 is stopped and the feed roller 54 and the retard roller 55 are rotated in the feeding direction by the movement of the sheet S1 conveyed by the pair of conveying rollers 56. Then, the control unit C calculates time T3 at which the trailing end of the sheet S1 passes through a contact position between the pickup roller 53 and the sheet by the following Equation (1).

$$T3=(L-D)/V+T2 \quad (1)$$

L: Length of the sheet,

V: Conveying speed at which the sheet is conveyed by the pair of conveying rollers, and D: Sum of the lengths of straight lines connecting four points, which are point P1 at which the pickup roller 53 contacts the sheet, nip center point P2 between the feed roller 54 and the retard roller 55, nip center point P3 between the pair of conveying rollers, and detection point of the conveyance sensor 56S.

Figure 16C:
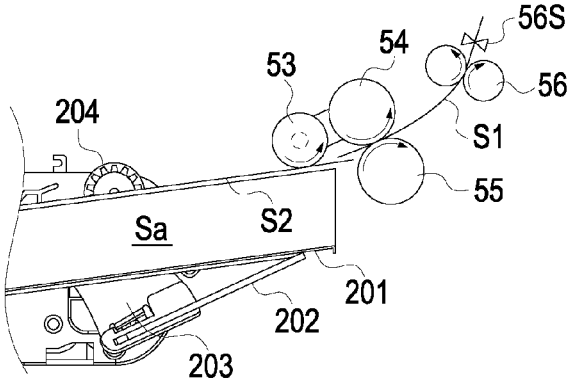
Figure 16D:
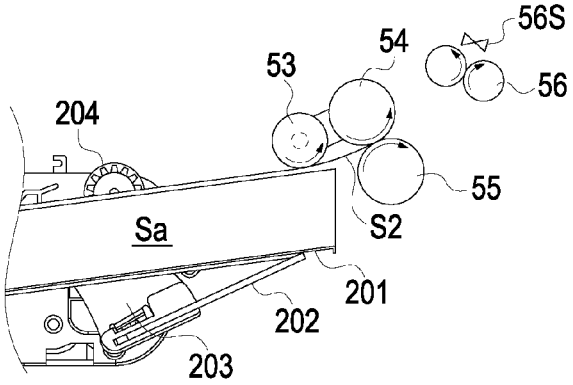

As illustrated in FIG. 15, at time T3 when the trailing end of the sheet S1 passes through the contact position between the pickup roller 53 and the sheet, the intermediate plate 201 is raised so that the pickup roller 53 comes into contact with the sheet S2 positioned under the sheet S1, as illustrated in FIG. 16C. At this time, the sheet S1 that is being conveyed by the pair of conveying rollers 56 is nipped by the retard roller 55. Therefore, the retard roller 55 and the pickup roller 53 are rotated in the feeding direction. When the trailing end of the sheet S1 leaves the pickup roller 53, the pickup roller 53 starts conveying the next sheet S2 that is positioned under the sheet S1. Then, when the trailing end of the sheet S1 leaves the nip position between the feed roller 54 and the retard roller 55, the rotation of the retard roller 55 stops. At the same time, the rotation of the pickup roller 53 also stops. Accordingly, as illustrated in FIG. 16D, the next sheet S2 is stopped at a position where the leading end thereof is at the nip position between the feed roller 54 and the retard roller 55.

Then, as illustrated in FIG. 15, the intermediate plate 201 is moved to the separation position again at a time slightly delayed from time T4 at which the solenoid 103, which functions as a trigger for the feeding operation, releases the partially toothed gear 101. Then, the sheet feeding operation for the next uppermost sheet S1 is started. It is necessary to delay the time at which the intermediate plate 201 is moved to the separation position from the time T4 in consideration of the variation in the time at which the feed roller 54 starts to rotate. In the operation for feeding the next sheet S2, similar to the sheet S1, the sheet feeding operation is performed by moving the intermediate plate 201 at the timing similar to that in the conveyance of the sheet S1. Accordingly, the sheet feeding operation is always started while the leading end of the sheet is at the nip position between the feed roller 54 and the retard roller 55.

Figure 17A:
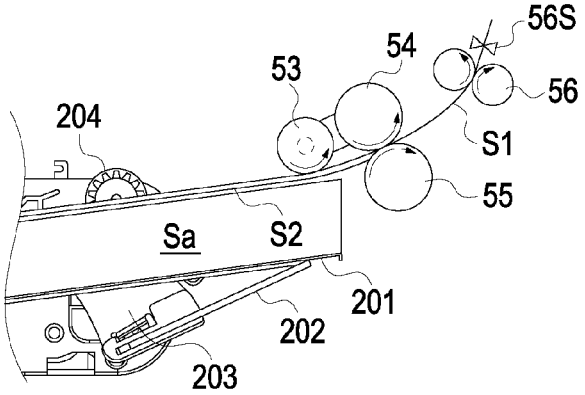
FIGS. 17A to 17D are diagrams illustrating the operation of the sheet feeding apparatus according to the fourth embodiment.
Figure 17B:
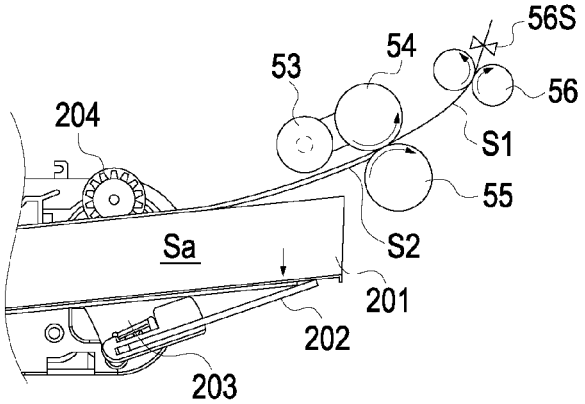
Figure 17C:
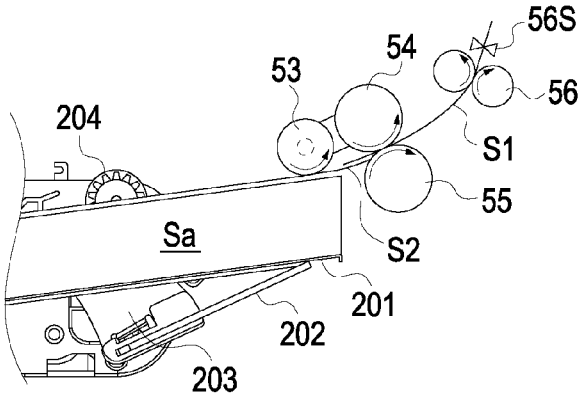
Figure 17D:
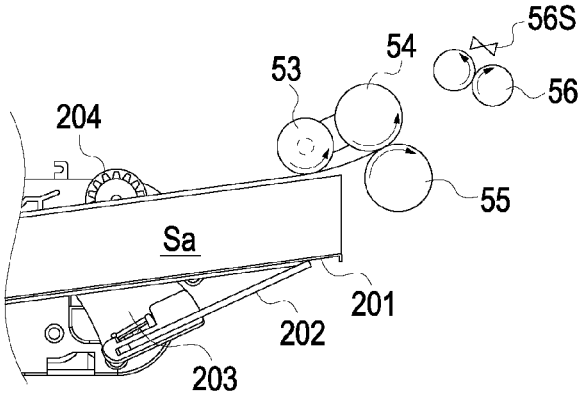

Next, the case in which sheets with a large coefficient of friction are successively fed will be described with reference to FIGS. 17A to 17D. That is, the case in which the coefficient of friction between the uppermost sheet S1 and the next sheet S2 positioned thereunder is large will be described. The operation of moving the intermediate plate 201 between the contact and separation positions is the same as that in the above-described case in which the coefficient of friction is small, and explanations thereof are thus omitted. When the sheet feeding signal is transmitted and the sheet S1 is conveyed, the sheet S2 is also conveyed to the nip position between the feed roller 54 and the retard roller 55 by the frictional force between the sheets S1 and S2, as illustrated in FIG. 17A. The retard roller 55 separates the sheets S1 and S2 from each other, so that only the sheet S1 is conveyed. After the sheet S1 is conveyed, the sheet S2 is stopped while the leading end of the sheet S2 to be fed next is stopped by the retard roller 55 at the nip position between the feed roller 54 and the retard roller 55, as illustrated in FIGS. 17B and 17C. Also in this case, the above-described process is repeated so that the sheet feeding operation for the next sheet is always started while the leading end of the sheet is at the nip position between the feed roller 54 and the retard roller 55, as illustrated in FIG. 17D.

As described above, irrespective of whether the coefficient of friction between the uppermost sheet S1 that is to be fed and the sheet S2 positioned thereunder is small or large, the leading end of the sheet S2 to be fed next is always at the nip position between the feed roller 54 and the retard roller 55. Also in the case where sheets having different coefficients of friction are mixed, one of the above-described sheet feeding operations is performed in accordance with the coefficient of friction between the sheet being fed and the next sheet, so that the sheet to be fed next is at the nip position between the feed roller 54 and the retard roller 55. Therefore, the variation in the position of the leading end of each sheet in the sheet feeding operation can be minimized, and the stability of the sheet feeding operation can be increased.

In the case where the intermediate plate 201 is raised and lowered at the above-described timing, during the time in which the retard roller 55 is rotated, the pickup roller 53 is not in contact with the sheet except when the pickup roller 53 conveys the sheet to the nip position between the feed roller 54 and the retard roller 55. Therefore, there is a time in which the pickup roller 53 is not in contact with the sheet while the feed roller 54 and the retard roller 55 are rotated by the movement of the sheet that is being conveyed by the pair of conveying rollers 56. During this time, no pressure is applied to the sheet that is being conveyed or to the sheet positioned thereunder on the intermediate plate 201. Therefore, double feeding, in which the sheet that is being conveyed conveys the sheet positioned thereunder by the frictional force between the sheets, can be prevented.

In the present embodiment, the position of the pickup roller is fixed while the intermediate plate is moved between the contact and separate positions. However, similar effects can also be obtained when the pickup roller is moved between contact and separate positions.

Fifth Embodiment

Next, a fifth embodiment of the present invention will be described. The fifth embodiment differs from the first and second embodiments in that a structure for linking the rotation of the pickup roller and the rotation of the retard roller to each other is provided. To link the rotations, a gear train for driving the pickup roller and a gear train for driving the retard roller are connected to each other. The fifth embodiment differs from the third and fourth embodiments in that a structure for transmitting the driving force of the motor to the pickup roller while the driving force is transmitted to the feed roller is additionally provided. The fifth embodiment is characterized in that, in order to minimize the variation in the intermittent driving performed by the partially toothed gear, the partially toothed gear is rotated several revolutions in the operation for conveying a single sheet, while a means for bringing the pickup roller into contact with the uppermost sheet or moving the pickup roller away from the uppermost sheet is rotated only a single revolution. Components similar to those in the first and second embodiments are denoted by the same reference numerals, and detailed explanations thereof are thus omitted.

Figure 18A:
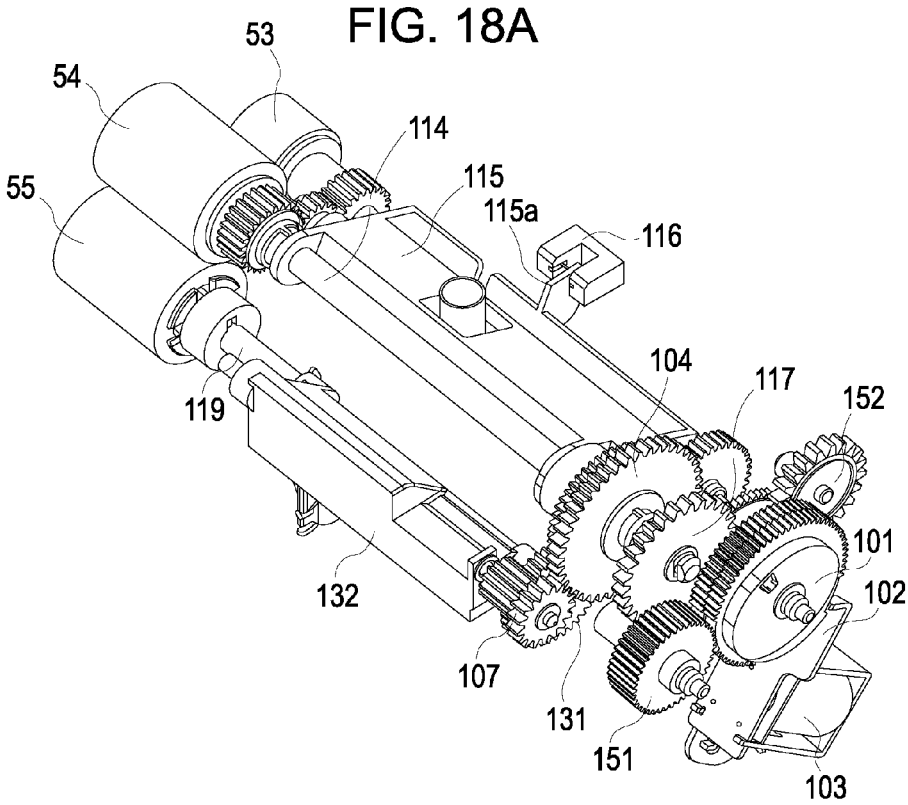
FIGS. 18A and 18B are perspective views of a sheet feeding apparatus according to a fifth embodiment.
Figure 18B:
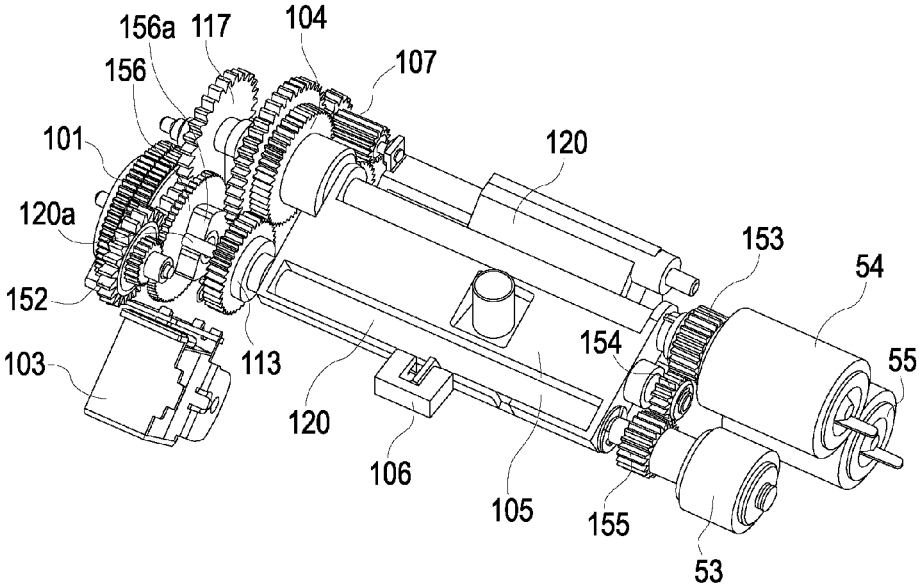

A rotational drive mechanism according to the fifth embodiment will be described with reference to FIGS. 18A and 18B. FIG. 18A is a perspective view of a sheet feeding section viewed from the back in the feeding direction, and FIG. 18B is a perspective view of the sheet feeding section viewed from the front.

Reference numeral 151 denotes a gear to which the driving force is transmitted from the drive motor 100. Similar to the first embodiment, the driving force from the drive motor 100 is transmitted through the gear 151 so that the intermittent driving can be performed by the partially toothed gear 101 and the solenoid 103. The partially toothed gear 101 transmits the driving force to the shaft 114 through the gear 117. The limiter gear 104 is engaged with the shaft 114 with a torque limiter provided therebetween. The feed roller 54 and a gear 153 are connected to the shaft 114 with a one-way clutch provided in the gear 153. The driving force is transmitted when the shaft 114 rotates in the feeding direction, and the feed roller 54 and the gear 153 are freely rotatable in the feeding direction while the shaft 114 is stationary. The pickup roller 53 is fixed to the shaft 120 that is supported in a rotatable manner. The gear 153 meshes with a gear 154, which meshes with a gear 155. The gear 155 is formed integrally with the pickup roller 53. The limiter gear 104 transmits the driving force also to the gear 113, and the gear 113 is connected to the shaft 120 with a one-way clutch provided therebetween. The driving force is transmitted to the shaft 120 when the gear 113 rotates in the feeding direction, and is not transmitted when the gear 113 is stationary or is rotated in the reverse direction.

The limiter gear 104 is connected to the shaft 119, to which the retard roller 55 is fixed, with a stepped gear 107 provided therebetween. The partially toothed gear 101 meshes with a stepped gear 152, which meshes with a cam gear 156. When the partially toothed gear 101 rotates three revolutions, the cam gear 156 rotates one revolution. A cam surface 156*a* is provided on the cam gear 156. When the cam gear 156 rotates, the cam surface 156*a* pushes an end portion 120*a* of the shaft 120 upward, thereby vertically moving the pickup roller 53.

Next, the partially toothed gear 101 will be described in detail. To reduce the variation in the position of the leading end of the sheet in the sheet feeding operation, it is necessary to reduce the variation in transmission of the driving force from when the solenoid 103 is turned on to when the feed roller 54 and the pickup roller 53 start to rotate. It is known that, in the case where the intermittent driving is performed by the partially toothed gear 101 and the solenoid 103, the variation in transmission of the driving force corresponds to the distance by which the sheet is conveyed by the feed roller 54 while the partially toothed gear 101 rotates by an amount corresponding to a single tooth. Therefore, according to the present embodiment, the module of the partially toothed gear 101 is set to be smaller than the module of the gear 117. It is also effective to increase the number of teeth included in the partially toothed gear 101. However, since the space is limited, according to the present embodiment, the partially toothed gear 101 is rotated three revolutions in the operation for conveying a single sheet. The structure will be described in detail below. Accordingly, the effect similar to that obtained when the number of teeth of the partially toothed gear 101 is tripled can be obtained.

Figure 19A:
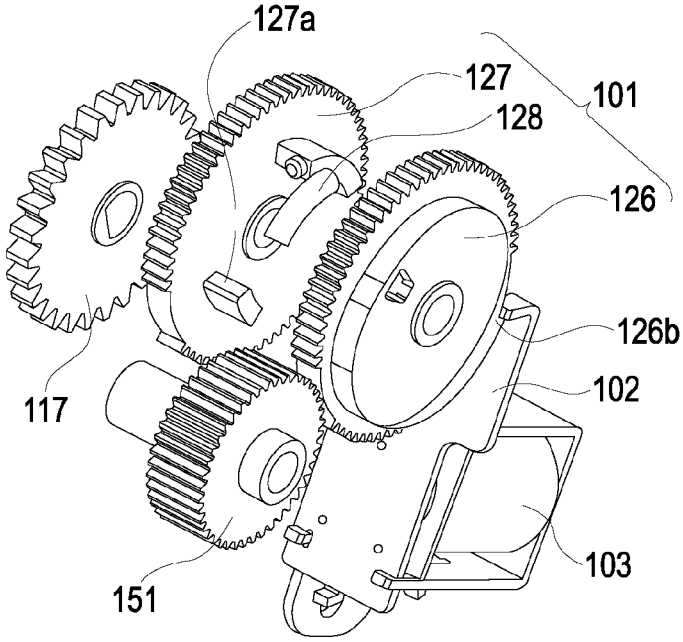
FIGS. 19A and 19B are perspective views of a drive input unit provided in the sheet feeding apparatus illustrated in FIGS. 18A and 18B.
Figure 19B:
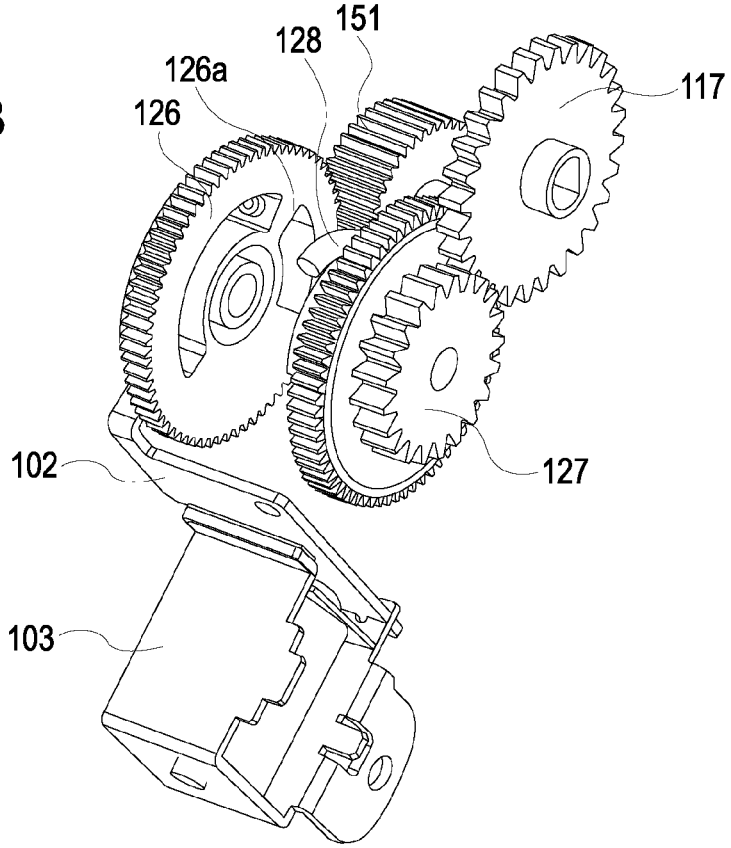

FIGS. 19A and 19B are exploded perspective views illustrating the components of the partially toothed gear 101. The partially toothed gear 101 includes a gear 126 which has an engagement portion 126*b* and which is stopped when the lever member 102 is engaged with the engagement portion 126*b*; a gear 127 that is provided coaxially with the gear 126; and a spring 128 that urges the gear 126 and the gear 127 in a rotational direction. The gear 127 meshes with the gear 117 which is connected to the feed roller 54, and transmits the driving force to the feed roller 54.

Figure 20A:
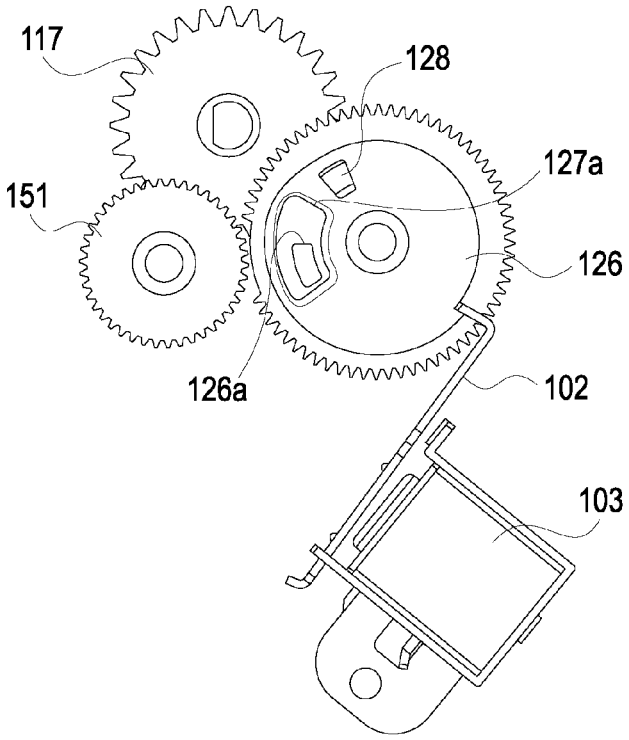
FIGS. 20A and 20B are diagrams illustrating the operation of the drive input illustrated in FIGS. 19A and 19B.
Figure 20B:
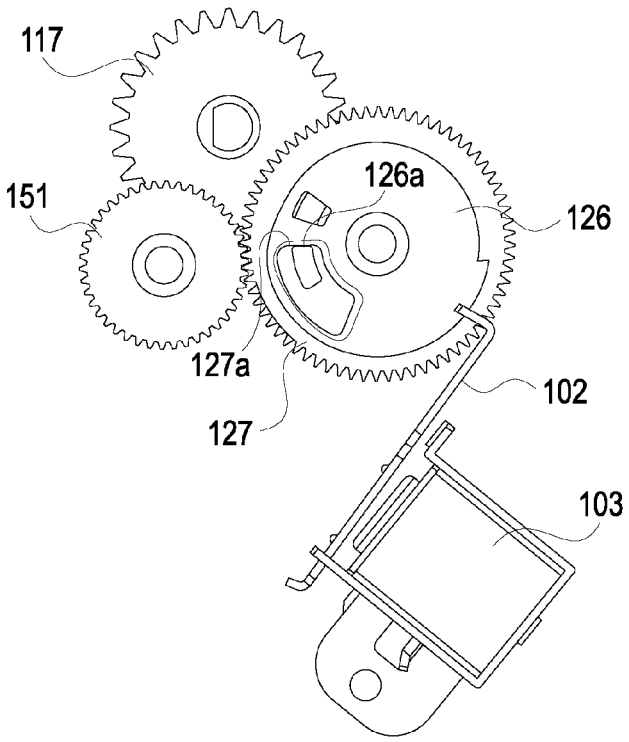

The operation of the partially toothed gear 101 will be described with reference to FIGS. 20A and 20B. While the gear 126 is restrained by the lever member 102, the toothless portion of the gear 126 faces the gear 151 that receives the driving force from the drive motor 100. When the solenoid 103 is turned on, the lever member 102 is pulled by the solenoid 103 and the gear 126 is released from the lever member. Accordingly, the gear 126 is rotated by the spring 128 and meshes with the gear 151 that receives the driving force from the drive motor 100. Accordingly, the rotation of the gear 151 is transmitted to the gear 126. When the gear 126 is rotated by a certain angle by the gear 151, abutting portions 126*a* and 127*a* provided on the gears 126 and 127, respectively, come into contact with each other. As a result, the gear 127 starts to rotate. The gear 127 that has been rotated by the gear 126 meshes with the gear 151, so that the driving force is transmitted to both the gear 126 and the gear 127 from the gear 151. While the abutting portions 126*a* and 127*a* are in contact with each other, the teeth of the gears 126 and 127 are arranged so as to cover the entire circumference. Therefore, the driving force can be continuously transmitted. More specifically, the toothless portion of the gear 126 is covered by the gear portion of the gear 127, and the gears 126 and 127 substantially function as a gear having teeth arranged over the entire circumference. Therefore, when the solenoid 103 is turned off at the time when the partially toothed gear 101 has been rotated about two and a half revolutions, the lever member 102 restrains and stops the partially toothed gear 101, and the partially toothed gear 101 can be rotated three revolutions in the operation of conveying a single sheet.

The sequence of the sheet feeding operation according to the fifth embodiment will now be described with reference to FIGS. 21A to 23B. At the time when the sheet feeding operation is started, the pickup roller 53 is in contact with the uppermost sheet S1 on the intermediate plate 201. When the feeding signal is transmitted from the LBP 1, the solenoid 103 is turned on and the partially toothed gear 101 is released from the lever member 102. Accordingly, the driving force from the drive motor 100 is transmitted to the partially toothed gear 101 through the gear 151. When the driving force is transmitted to the partially toothed gear 101, the shaft 114 is rotated in the feeding direction by the gear 117, so that the feed roller 54 and the pickup roller 53 are rotated in the feeding direction. When the shaft 117 rotates in feeding direction, the retard roller 55 receives a driving force in the direction opposite to the feeding direction through the limiter gear 104. However, since the rotating force of the feed roller 54 overpowers the rotating force of the torque limiter provided in the limiter gear 104, the retard roller 55 rotates in the feeding direction. Accordingly, the sheet S1 can be conveyed.

The sheet feeding operation differs depending on whether the coefficient of friction between the uppermost sheet S1 and the next sheet S2 positioned thereunder on the sheet feeding cassette is small or large. Therefore, the operation in each case will be described with reference to FIGS. 21A to 23B.

Figure 21A:
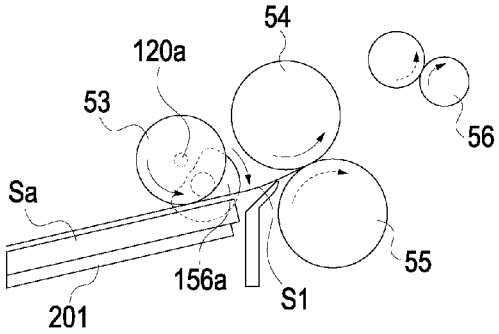
Figure 23A:
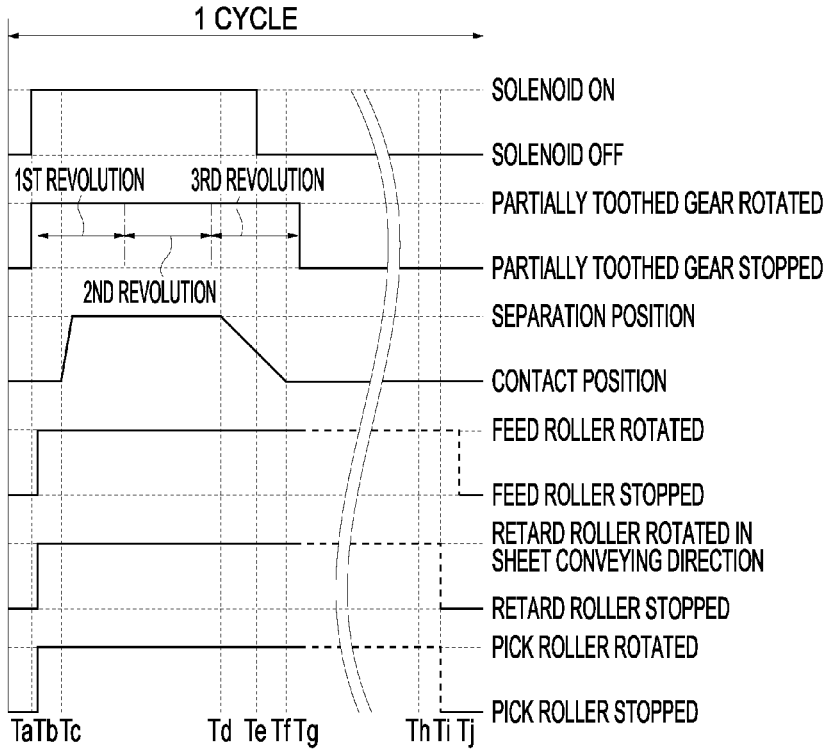
FIGS. 23A and 23B are timing charts of the operation of a feeding mechanism according to the fifth embodiment.
Figure 23B:
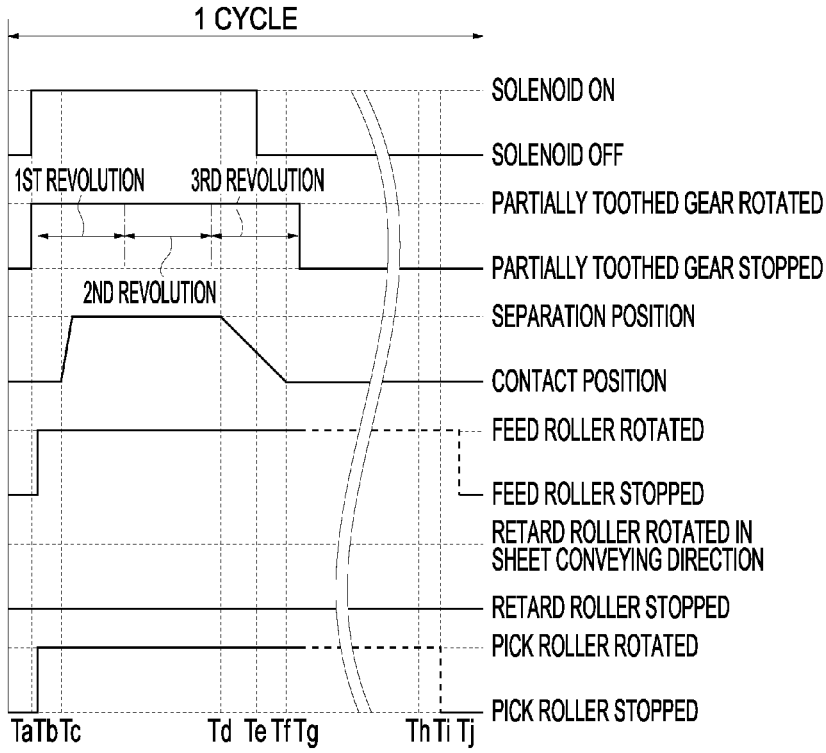
Figure 24A:
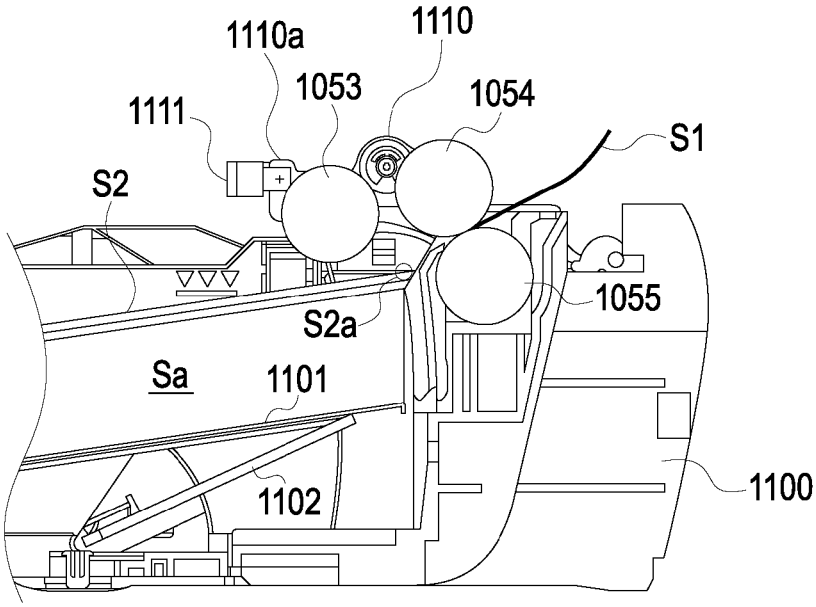
FIGS. 24A and 24B are sectional views of an example of a sheet feeding apparatus according to a related art.
Figure 24B:
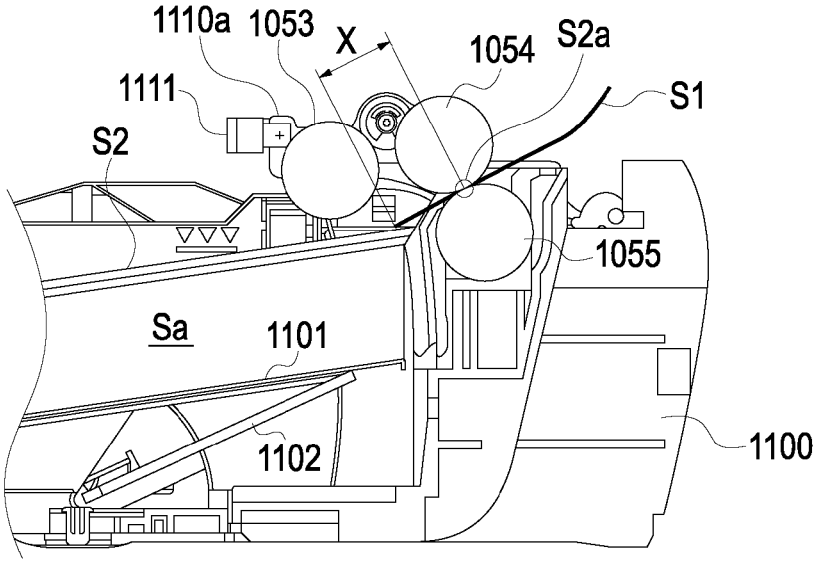

First, the case in which sheets with a small coefficient of friction are successively fed will be described. In the case where the coefficient of friction between the uppermost sheet S1 and the next sheet S2 positioned thereunder in the sheet feeding cassette is small, only the uppermost sheet S1 is conveyed to the nip position between the feed roller 54 and the retard roller 55, as illustrated in FIG. 21A. FIG. 23A illustrates timing charts of the on/off state of the solenoid 103 and the rotated/stopped state of the partially toothed gear 101 in the operation of conveying a single sheet. FIG. 23A also illustrates timing charts of the contact/separated state between the pickup roller 53 and sheet, the rotated/stopped state of the feed roller 54, the rotated/stopped state of the retard roller 55, and the rotated/stopped state of the pickup roller 53.

When the sheet feeding signal is transmitted from the LBP, the solenoid 103 is turned on and the lever member 102 releases the partially toothed gear 101, so that the partially toothed gear 101 starts to rotate (time Ta). Then, when the abutting portions 126*a* and 127*a* of the gears 126 and 127, respectively, of the partially toothed gear 101 come into contact with each other, the gear 127 starts to rotate the gear 117, the cam gear 156, and the shaft 114. Accordingly, the feed roller 54 and the pickup roller 53 start to rotate in response to the rotation of the shaft 114. The retard roller 55 receives a driving force in the direction opposite to the conveying direction from the shaft 114. However, since the rotating force of the feed roller 54 is larger than the transmitting driving force (limit value) of the torque limiter provided in the limiter gear 104, the retard roller 55 starts to rotate in the feeding direction (time Tb). Thus, feeding of the sheet S1 is started. When the partially toothed gear 101 further rotates, the cam gear 156 rotates such that the cam surface 156*a* pushes the shaft 120*a* upward, as illustrated in FIG. 21B. Therefore, the pickup roller 53 starts to move away from the sheet S1 (time Tc). Then, the sheet S1 reaches the pair of conveying rollers 56 as illustrated in FIG. 21C, and is further conveyed.

Figure 21D:
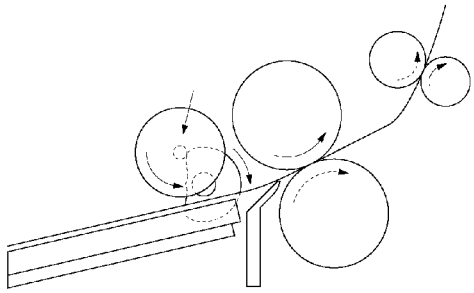
Figure 21B:
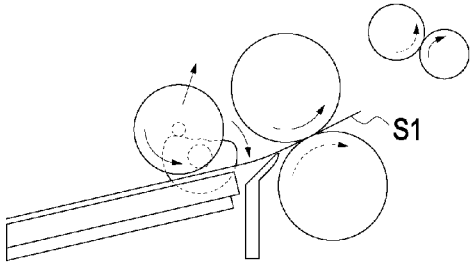

Then, when the partially toothed gear 101 has rotated until time Td, the cam surface 156*a* starts to gradually move the shaft end portion 114*a* downward, as illustrated in FIG. 21D, so that the pickup roller 53 comes into contact with the sheet S1 again (time Tf). The solenoid 103 is turned off at time Te when the partially toothed gear 101 has rotated about two and a half revolutions. Accordingly, the lever member 102 engages with the engagement portion 126*b* and stops the rotation of the partially toothed gear 101 (time Tg). When the rotation of the partially toothed gear 101 is stopped, the shaft 114 stops rotating so that the transmission of the driving force from the motor to the feed roller 54 and the pickup roller 53 is also stopped. Owing to the operations of the one-way clutch provided in the feed roller 54 and the torque limiter provided in the limiter gear 104, the feed roller 54 and the retard roller 55 are rotated in the feeding direction by the movement of the sheet S1 that is being conveyed by the pair of conveying rollers 56. Since the retard roller 55 is rotated in the feeding direction, the pickup roller 53 is also rotated in the feeding direction by the gear 131, the gear 107, the limiter gear 104, the gear 113, and the shaft 120.

Figure 21E:
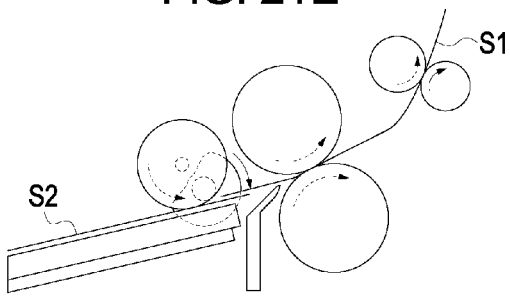
Figure 21C:
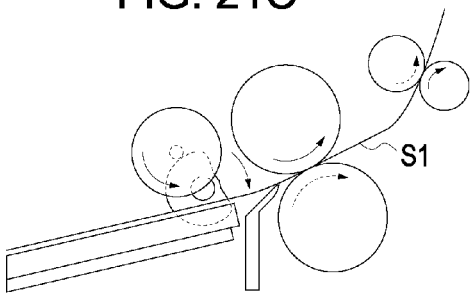

In FIG. 23A, the dashed lines show the range in which the rollers are rotated by the movement of the sheet S1 that is conveyed by the pair of conveying rollers 56. The rotation of the pickup roller 53 is transmitted to the gear 153 through the gears 155 and 154, so that the gear 153 is rotated in the feeding direction. However, the driving force is not transmitted to the shaft 114, owing to the one-way clutch provided in the gear 153. Since the shaft 114 is stationary, the driving force in the direction opposite to the feeding direction is not transmitted to the retard roller 55. Then, when the trailing end of the sheet S1 leaves the pickup roller 53, the pickup roller 53 comes into contact with the next sheet S2, as illustrated in FIG. 21E. At this time, since the pickup roller 53 is rotated, the sheet S2 is conveyed while the leading end thereof is placed on the trailing end of the sheet S1.

Figure 21F:
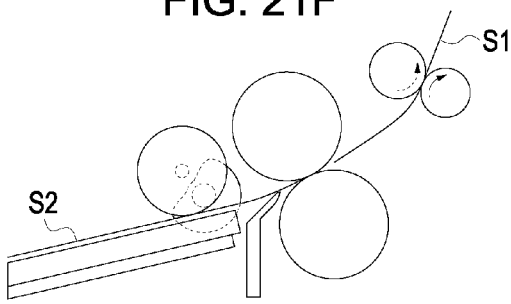

Then, when the sheet S2 reaches the nip position between the feed roller 54 and the retard roller 55, the retard roller 55 stops rotating to separate the sheet S2. When the rotation of the retard roller 55 stops, the rotation of the pickup roller 53 also stops (Ti) since the retard roller 55 and the pickup roller 53 are connected to each other with a gear. The sheet S1 is continuously conveyed by the pair of conveying rollers 56. Therefore, when the trailing end of the sheet S1 leaves the feed roller 54 and the retard roller 55, the rotation of the feed roller 54 stops, as illustrated in FIG. 21F. Accordingly, the pickup roller 53, the feed roller 54, and the retard roller 55 are all stopped while the next sheet S2 is at the nip position between the feed roller 54 and the retard roller 55. The above-described process is repeated so that the sheet feeding operation is always started while the leading end of the sheet is at the nip position between the feed roller 54 and the retard roller 55.

Figure 22A:
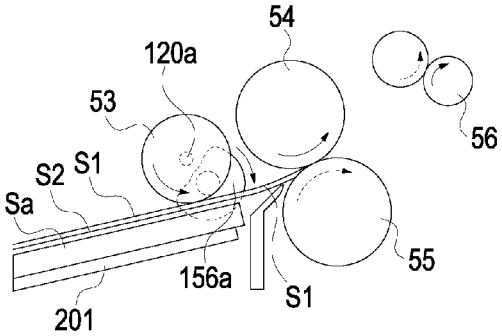
FIGS. 22A to 22F show diagrams illustrating the operation of the sheet feeding apparatus according to the fifth embodiment.
Figure 22D:
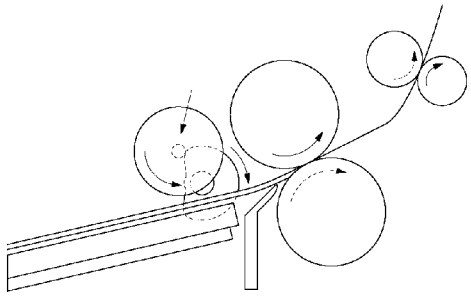
Figure 22B:
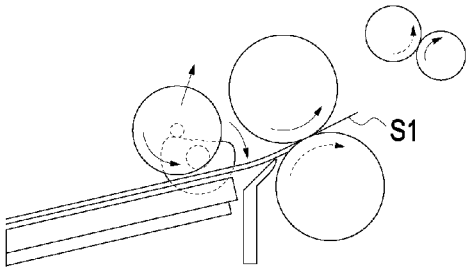
Figure 22E:
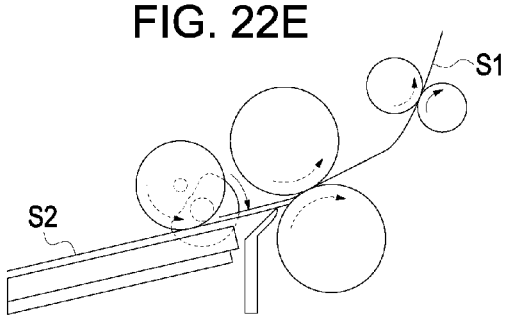
Figure 22C:
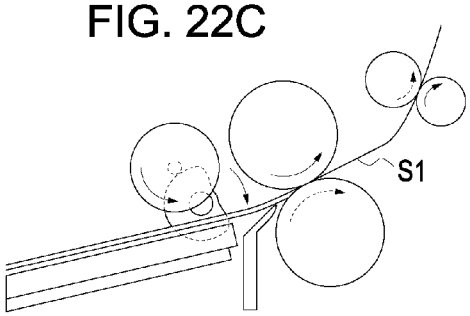

Next, the case in which sheets with a large coefficient of friction are successively fed will be described. More specifically, the case in which the coefficient of friction between the uppermost sheet S1 and the next sheet S2 positioned thereunder is large will be described with reference to FIGS. 22A to 22F and 23B. In the case where the coefficient of friction between the sheet S1 and the sheet S2 positioned thereunder is large, the sheet S1 and the sheet S2 are stopped at the nip position between the feed roller 54 and the retard roller 55, as illustrated in FIG. 22A. When the sheet feeding signal is transmitted from the LBP 1 in this state, the pickup roller 53 and the feed roller 54 start to rotate. Since the sheet S2 is already at the nip position between the feed roller 54 and the retard roller 55, the retard roller 55 separates and stops the sheet S2 (time Tb). As illustrated in FIGS. 22B, 22C, and 22D, the pickup roller 53 moves upward away from the sheet S1 while the retard roller 55 is stationary (time Tc). Then, the sheet S1 reaches the pair of conveying rollers 56, and the pickup roller 53 moves downward again and comes into contact with the sheet S1 (time Te).

Figure 22F:
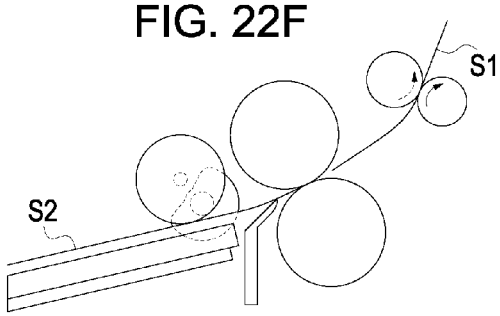

Then, the rotation of the partially toothed gear 101 is stopped (time Tf). However, the feed roller 54 is continuously rotated by the movement of the sheet S1 that is conveyed by the pair of conveying rollers 56. At this time, since both the retard roller 55 and the shaft 114 are stationary, no driving force for rotating the pickup roller 53 is generated. However, since the pickup roller 53 is in contact with the sheet S1, the pickup roller 53 is rotated by the movement of the sheet S1, owing to the one-way clutches provided in the gear 113 and the gear 153. As illustrated in FIG. 22E, when the trailing end of the sheet S1 leaves the pickup roller 53 (time Tg), the pickup roller 53 stops. Then, when the trailing end of the sheet S1 leaves the nip position between the feed roller 54 and the retard roller 55, the feed roller 54 also stops, as illustrated in FIG. 22F. Accordingly, the pickup roller 53, the feed roller 54, and the retard roller 55 are all stopped while the sheet S2 is at the nip position between the feed roller 54 and the retard roller 55. The above-described process is repeated so that the sheet feeding operation is always started while the leading end of the sheet is at the nip position between the feed roller 54 and the retard roller 55.

As described above, the variation in the transmission of the driving force to the feed roller 54 can be reduced by setting the module of the partially toothed gear 101 small and rotating the partially toothed gear 101 several revolutions in the operation of conveying a single sheet. In addition, the conveying force can be increased by rotating the pickup roller 53 with the driving force from the motor when the sheet feeding operation is started. In addition, the sheet feeding operation can always be started while the leading end of the next sheet is at the nip position between the feed roller 54 and the retard roller 55. Therefore, the variation in the position of the leading end of the sheet in the sheet feeding operation can be minimized, and the stability of the sheet feeding operation can be increased.

In the present embodiment, the driving force in the direction opposite to the feeding direction is applied through the torque limiter when the driving force is transmitted to the feed roller, and is not applied when the driving force is not transmitted to the feed roller. However, similar effects can also be obtained in the case where the driving force in the direction opposite to the feeding direction is continuously applied or is not applied.

In the above-described second to fifth embodiments, the structure in which the driving force is applied to the retard roller is described. However, also in the second to fifth embodiments, the separation roller according to the modification of the first embodiment (FIG. 6), to which no driving force is transmitted, may be used. In this case, the pickup roller and the separation roller may be connected to each other with a gear train provided with a torque limiter. When a driving force larger than or equal to the driving force of the torque limiter is applied from the feed roller to the separation roller and the separation roller rotates in the feeding direction, the pickup roller also rotates in the feeding direction.

According to the present invention, the pickup roller is set to a state in which the pickup roller can feed the sheet when the retard roller is rotating in the feeding direction, and is set to a state in which the pickup roller does not feed the sheet when the retard roller is rotating in the direction opposite to the feeding direction or is stationary. Accordingly, in the operation of successively feeding the sheets, the leading end of the next sheet can be positioned at the nip position between the feed roller and the retard roller. Therefore, variation in the sheet feeding operation can be reduced without complex control. As a result, the intervals between the sheets being conveyed can be reduced compared to those in the sheet feeding apparatus according to the related art, and the productivity can be increased. In addition, in the case where the number of sheets that are fed per unit time is constant, the speed of the image forming process can be reduced. Therefore, the reliability of the image quality can be increased and the energy consumption can be reduced. In general, the image quality can be increased by reducing the speed of the image forming process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/062671, filed Jul. 13, 2009, which is hereby incorporated by reference herein in its entirety.

What is claimed is:

1. A sheet feeding apparatus, comprising:

a sheet stacking portion on which sheets are stacked;

a pickup roller that feeds an uppermost one of the sheets stacked on the sheet stacking portion;

a feed roller that feeds the sheet conveyed by the pickup roller;

a retard roller that is pressed against the feed roller and that receives a driving force in a direction opposite to a feeding direction through a torque limiter to separate the sheets one by one at a nip position between the feed roller and the retard roller;

a conveying portion, disposed downstream of the feed roller, that conveys the sheet separated by the retard roller;

a drive motor that drives the feed roller; and a control unit that controls such that, while the sheet feeding apparatus feeds the sheet successively, after the sheet fed out by the feed roller and the retard roller reaches the conveying portion, a transmission of the driving force from the drive motor to the feed roller is stopped and the feed roller and the retard roller are rotated in the sheet feeding direction by a movement of the sheet conveyed by the conveying portion, and such that when the retard roller is rotating in the feeding direction by the movement of the sheet conveyed by the conveying portion, the pickup roller feeds a sheet on the sheet stacking portion so that a leading end of the sheet to be fed next from the sheet stacking portion is at the nip position between the feed roller and the retard roller.

2. The sheet feeding apparatus according to claim 1, further comprising a moving unit that moves the pickup roller between a contact position where the pickup roller is in contact with the uppermost one of the sheets stacked on the sheet stacking portion to feed the sheet and a position where the pickup roller is separated from the uppermost one of the sheets stacked on the sheet stacking portion when the retard roller is rotating in the direction opposite to the feeding direction to separate the sheets one by one, wherein the control unit controls the moving unit so that the pickup roller feeds the sheet to be fed next at the contact position when the retard roller is rotating in the feeding direction by the movement of the sheet conveyed by the conveying portion.

3. The sheet feeding apparatus according to claim 1, further comprising a lifter unit that raises and lowers the sheet stacking portion, the lifter unit moving the sheet stacking portion between a contact position where the uppermost one of the stacked sheets is in contact with the pickup roller to feed the sheet and a position where the uppermost one of the stacked sheets is separated from the pickup roller when the retard roller is rotating in the direction opposite to the feeding direction to separate the sheets one by one, wherein the control unit controls the lifter unit so that the sheet stacking portion is moved to the contact position where the uppermost one of the sheets is in contact with the pickup roller when the retard roller is rotating in the feeding direction by the movement of the sheet conveyed by the conveying portion.

4. The sheet feeding apparatus according to claim 1, further comprising a drive transmitting portion that transmits the rotation of the retard roller in the feeding direction to the pickup roller so that a driving force is transmitted to the pickup roller so that the pickup roller rotates in a direction for conveying the sheet from the sheet stacking portion when the retard roller is rotating in the feeding direction by the movement of the sheet conveyed by the conveying portion, wherein the transmission of the driving force is stopped when the retard roller is rotating in the direction opposite to the feeding direction to separate the sheet one by one.

5. The sheet feeding apparatus according to claim 1, further comprising detection means for detecting a rotation of the retard roller, wherein the pickup roller is set to a sheet feeding state when it is determined that the retard roller is rotating in the feeding direction by the movement of the sheet conveyed by the conveying portion on the basis of the detection performed by the detecting means, and is set to a sheet non-feeding state when it is determined that the retard roller is rotating in the direction opposite to the feeding direction on the basis of the detection performed by the detecting means.

6. The sheet feeding apparatus according to claim 1, wherein the pickup roller and the retard roller are connected to a drive motor with a gear provided with a torque limiter, and wherein, when a force larger than or equal to a driving force of the torque limiter is applied to the retard roller so that the retard roller rotates in the feeding direction, the pickup roller rotates in the feeding direction.

7. The sheet feeding apparatus according to claim 1, wherein the pickup roller is movable between a position where the pickup roller is in contact with the uppermost one of the sheets stacked on the sheet stacking portion and a position where the pickup roller is separated from the uppermost one of the sheets stacked on the sheet stacking portion, and wherein the pickup roller is at the position where the pickup roller is in contact with the uppermost one of the sheets when the trailing end of the sheet that is being conveyed passes a contact position between the pickup roller and the uppermost one of the sheets, and moves away from the uppermost one of the sheets within a time from when the trailing end of the sheet passes the nip position between the feed roller and the retard roller to when the pickup roller starts conveying the next sheet.

8. The sheet feeding apparatus according to claim 7, wherein the trailing end of the sheet is calculated at a time that the trailing end of the sheet being conveyed passes a contact position between the pickup roller and the uppermost one of the sheets on the basis of a detection performed by a conveyance sensor disposed on a conveying path at a position downstream of the conveying portion.

9. The sheet feeding apparatus according to claim 1, further comprising a lifter unit that raises and lowers the sheet stacking portion, the lifter unit moving the sheet stacking portion between a position where the uppermost one of the stacked sheets is in contact with the pickup roller and a position where the uppermost one of the sheets is separated from the pickup roller, wherein the sheet stacking portion is at the position where the uppermost one of the stacked sheets is in contact with the pickup roller when the trailing end of the sheet that is being conveyed passes a contact position between the pickup roller and the uppermost one of the sheets, and is moved to the position where the uppermost one of the sheets is separated from the pickup roller within a time from when the trailing end of the sheet passes the nip position between the pickup roller and the retard roller to when the feed roller starts conveying the next sheet.

10. The sheet feeding apparatus according to claim 1, wherein the pickup roller rotates in the feeding direction when the driving force is transmitted to the feed roller or when the retard roller is rotating in the feeding direction by the movement of the sheet conveyed by the conveying portion, and is not rotationally driven when the driving force is not transmitted to the feed roller and when the retard roller is rotating in the direction opposite to the feeding direction to separate the sheet one by one.

11. An image forming apparatus, comprising:

sheet feeding apparatus according to claim 1; and an image forming unit that forms an image on the sheet fed by the sheet feeding apparatus.

12. The sheet feeding apparatus according to claim 1, wherein the pickup roller and the retard roller are connected to each other with gears, and wherein a rotation of the retard roller in the feeding direction by the movement of the sheet conveyed by the pair of conveying rollers is transmitted to the pickup roller to be rotated in the feeding direction by the gears.

13. The sheet feeding apparatus according to claim 1, further comprising a moving unit that moves the pickup roller between a contact position where the pickup roller is in contact with the uppermost one of the sheets stacked on the sheet stacking portion and a separation position where the pickup roller is separated from the uppermost one of the sheets stacked on the sheet stacking portion, and wherein the control unit controls the moving unit to move the pickup roller from the contact position to the separation position when the leading end of the sheet passes the nip position between the feed roller and the retard roller and to move the pickup roller from the separation position to the contact position when the trailing end of the sheet that is being conveyed passes a contact position between the pickup roller and the uppermost one of the sheets.

14. A sheet feeding apparatus, comprising:

a sheet stacking portion on which sheets are stacked;

a pickup roller that feeds an uppermost one of the sheets stacked on the sheet stacking portion;

a feed roller that feeds the sheet conveyed by the pickup roller; and a separation roller which is pressed against the feed roller and to which a torque limiter is connected and which separates the sheets one by one at a nip position between the feed roller and the separation roller;

a conveying portion disposed downstream of the feed roller, that conveys the sheet separated by the separation roller;

a drive motor that drives the feed roller: and a control unit that controls such that, while the sheet feeding apparatus feeds the sheet successively, after the sheet fed out by the feed roller and the separation roller reaches the conveying portion, a transmission of the driving force from the drive motor to the feed roller is stopped and the feed roller and the separation roller are rotated in the sheet feeding direction by a movement of the sheet conveyed by the conveying portion, and such that when the separation roller is rotating in the feeding direction by the movement of the sheet conveyed by the conveying portion, the pickup roller feeds a sheet on the sheet stacking portion so that a leading end of the sheet to be fed next from the sheet stacking portion is at the nip position between the feed roller and the separation roller.

15. The sheet feeding apparatus according to claim 14, wherein the pickup roller and the separation roller are connected to each other with gears, and wherein a rotation of the separation roller in the feeding direction by the movement of the sheet conveyed by the pair of conveying rollers is transmitted to the pickup roller to be rotated in the feeding direction by the gears.

16. The sheet feeding apparatus according to claim 14, wherein the pickup roller conveys the sheet by rotating in the feeding direction when the driving force is transmitted to the feed roller or when the separation roller is rotating in the feeding direction by the movement of the sheet conveyed by the pair of conveying rollers, and is not rotationally driven when the driving force is not transmitted to the feed roller and when the separation roller is stationary to separate the sheets one by one.

* * * * *